US011331590B2

(12) United States Patent
Grove

(10) Patent No.: US 11,331,590 B2
(45) Date of Patent: May 17, 2022

(54) BUILDING BLOCK

(71) Applicant: Evan B. Grove, New York, NY (US)

(72) Inventor: Evan B. Grove, New York, NY (US)

( * ) Notice: Subject to any disclaimer, the term of this patent is extended or adjusted under 35 U.S.C. 154(b) by 0 days.

(21) Appl. No.: 16/634,196

(22) PCT Filed: Aug. 17, 2018

(86) PCT No.: PCT/US2018/046915
§ 371 (c)(1),
(2) Date: Jan. 27, 2020

(87) PCT Pub. No.: WO2019/036623
PCT Pub. Date: Feb. 21, 2019

(65) Prior Publication Data

US 2021/0101086 A1 Apr. 8, 2021

Related U.S. Application Data

(60) Provisional application No. 62/547,274, filed on Aug. 18, 2017.

(51) Int. Cl.
*A63H 33/04* (2006.01)
*A63H 33/08* (2006.01)

(52) U.S. Cl.
CPC ..... *A63H 33/046* (2013.01); *A63H 33/086* (2013.01)

(58) Field of Classification Search
CPC ..... A63H 33/046; A63H 33/086
(Continued)

(56) References Cited

U.S. PATENT DOCUMENTS 2,570,625 A * 10/1951 Zimmerman ..... A63H 33/046 446/419
3,005,282 A 10/1961 Christiansen
(Continued)

FOREIGN PATENT DOCUMENTS

KR 2018044593 * 5/2018 ..... A63H 33/04

OTHER PUBLICATIONS

Chae, KR 2018044593 Machine Translation, uploaded Jul. 27, 2021, Espacenet, 6 pages.*
(Continued)

*Primary Examiner* — Eugene L Kim
*Assistant Examiner* — Matthew B Stanczak
(74) *Attorney, Agent, or Firm* — John H. Choi & Associates

(57) ABSTRACT

The present invention discloses a polyhedral block with a plurality of intermittently magnetic sides. The magnetic intermittency is caused by a freely movable magnet that resides in and traverses in an inner cavity, exerting its pull-force through the side of the block to which it is nearest. The cavity is shaped to facilitate magnet movement in response to encountering an external magnetically attractable surface. As a user rotates the block on a magnetically attractable surface, the contained magnet is caused to move within its cavity, ultimately resting in a user-selected position on the magnetically attractable surface. The block contains one or more non-magnetic connection elements on its sides. These non-magnetic connection elements serve to connect the block with compatible, non-magnetic blocks and other objects.

13 Claims, 45 Drawing Sheets

(58) Field of Classification Search
USPC ..... 446/92
See application file for complete search history.

(56) References Cited

U.S. PATENT DOCUMENTS 3,400,932 A * 9/1968 Conrad ..... A63F 9/0413 273/146
3,954,269 A * 5/1976 Brittingham ..... A63F 9/0415 273/146
4,513,970 A * 4/1985 Opresco ..... A63F 9/34 273/153 S
D279,915 S 7/1985 Arnau Pibet
4,552,541 A 11/1985 Bolli
D285,813 S 9/1986 Takahashi
4,741,534 A * 5/1988 Rogahn ..... G09F 7/04 40/907
5,347,253 A * 9/1994 Ogikubo ..... A63F 9/34 446/92
D368,497 S 4/1996 Schmidt et al.
D368,939 S 4/1996 Frederiksen
D378,837 S 4/1997 Olsen et al.
D378,838 S 4/1997 Olsen et al.
6,749,480 B1 * 6/2004 Hunts ..... A63H 33/046 446/85
6,919,787 B1 * 7/2005 Macken ..... H01F 7/0252 335/302
7,383,653 B1 * 6/2008 Hiromori ..... G09F 7/04 40/661.01
7,413,493 B2 * 8/2008 Toht ..... A63H 33/046 446/131
7,955,156 B2 6/2011 Toht et al.
7,985,116 B2 * 7/2011 Song ..... A63H 33/046 446/92
8,016,636 B2 * 9/2011 Park ..... A63H 33/046 446/131
8,187,006 B2 * 5/2012 Rudisill ..... H01R 11/30 362/249.06
D696,360 S 12/2013 Holm
D701,925 S 4/2014 Jensen
8,695,979 B1 * 4/2014 Seldin ..... G09B 21/001 446/419
D707,756 S 6/2014 Jensen
D714,401 S 9/2014 Lin
8,850,683 B2 * 10/2014 Haughey ..... A63H 33/046 446/124
8,905,812 B2 12/2014 Pai-Chen
9,022,829 B2 5/2015 Rosen et al.
D749,680 S 2/2016 Lin
9,266,015 B1 * 2/2016 Estrada ..... A63F 9/20
D757,862 S 5/2016 Ryaa
9,433,871 B2 9/2016 Park
D771,200 S 11/2016 Ryaa
9,662,592 B2 5/2017 Haughey et al.
9,821,244 B1 * 11/2017 Whang ..... A63H 33/046
D806,181 S 12/2017 Johannsen
D818,056 S 5/2018 Lo
D849,853 S 5/2019 Chen et al.
10,657,844 B2 * 5/2020 Stuart ..... G09B 23/20
D890,858 S * 7/2020 Grove ..... D21/499
10,886,050 B2 * 1/2021 Osipov ..... H01F 7/021
10,886,051 B2 * 1/2021 Osipov ..... A63H 33/042
2002/0115373 A1 8/2002 Lazerman
2003/0148699 A1 * 8/2003 Balanchi ..... A63H 33/046 446/85
2004/0116038 A1 6/2004 Hunts
2005/0170739 A1 * 8/2005 Zoellner ..... A63H 33/046 446/92
2006/0240737 A1 * 10/2006 Yoon ..... A63H 33/046 446/92
2007/0060012 A1 * 3/2007 Comfort ..... A63H 33/086 446/168
2007/0148399 A1 * 6/2007 Chen ..... C23C 14/205 428/96
2009/0170396 A1 * 7/2009 Tardif ..... A63H 33/046 446/92
2010/0056013 A1 * 3/2010 Kaplan ..... A63H 33/046 446/92
2010/0075567 A1 * 3/2010 Kim ..... A63H 33/046 446/92
2010/0087119 A1 * 4/2010 Vicentelli ..... A63H 33/046 446/92
2010/0120322 A1 5/2010 Vicentelli
2011/0263177 A1 * 10/2011 Lemchen ..... A63H 33/046 446/87
2012/0164913 A1 6/2012 Pomeroy et al.
2012/0181223 A1 * 7/2012 Yang ..... B01J 19/32 210/150
2012/0270465 A1 10/2012 Park
2012/0309259 A1 12/2012 Mak
2014/0213139 A1 7/2014 Ferguson
2015/0065007 A1 3/2015 Klepper et al.
2015/0258462 A1 * 9/2015 Wei ..... A63H 33/06 446/92
2015/0258463 A1 * 9/2015 Park ..... A63H 33/106 446/124
2015/0262744 A1 * 9/2015 Wei ..... H01F 7/0221 335/306
2015/0367245 A1 * 12/2015 Ahn ..... A63H 33/08 446/92
2016/0074766 A1 3/2016 Choi
2017/0095747 A1 * 4/2017 Cheung ..... A63H 33/046
2017/0136381 A1 * 5/2017 Wei ..... A63H 33/042
2017/0197154 A1 * 7/2017 Bagley ..... A63H 33/046
2017/0216737 A1 * 8/2017 Kiribuchi ..... A63H 33/26
2017/0291116 A1 * 10/2017 MacDonald ..... A63H 33/046
2018/0304166 A1 * 10/2018 Tsai ..... A63H 18/08
2019/0201804 A1 * 7/2019 Khalus ..... A63H 33/046
2019/0240589 A1 * 8/2019 Rechkemmer ..... A63H 33/046
2019/0262737 A1 * 8/2019 Vicentelli ..... H01F 7/0221
2019/0358549 A1 * 11/2019 Osipov ..... A63F 9/24
2020/0161037 A1 * 5/2020 Osipov ..... A63F 9/0838
2020/0238190 A1 * 7/2020 Tusacciu ..... A63H 33/08
2020/0398175 A1 * 12/2020 Rosen ..... H01F 7/0221
2020/0406156 A1 * 12/2020 Rosen ..... A63H 33/042

OTHER PUBLICATIONS

International Search Report and Written Opinion in PCT/US18/46915, dated Nov. 2, 2018.

* cited by examiner

BUILDING BLOCK

CROSS-REFERENCE TO RELATED APPLICATION

This application claims priority to U.S. Provisional Application No. 62/547,274 entitled "Building Block with Freely Movable Magnet(s)," filed on Aug. 18, 2017, which is incorporated by reference in its entirety.

FIELD OF INVENTION

The present invention relates generally to the field of building blocks as a children's toy, a hobby and crafts item, a construction medium, or as an artistic medium. More specifically, the present invention relates to magnetic building blocks for use with other non-magnetic building blocks.

BACKGROUND OF THE INVENTION

A wide variety of construction blocks exist. Some feature "snapfit" connections, while others feature magnetic connections. With snapfit blocks (e.g., Megabloks®, Lego®, and Duplo®) a user mates the "male" or convex portion of one block with the "female" or concave portion of another block to create multi-block structures. With magnetic blocks, a user creates multi-block structures by mating a magnetically charged portion of one block with a magnetically charged portion of another block.

Snapfit block structures are limited by their support requirements, namely, each structure generally must begin on (and must be continually supported by) a substantially horizontal surface (e.g., a floor, a table, etc.). As a result, the orientation of the block structure is also generally limited, with male portions of the block facing upwards (i.e., towards the sky) and the female portions facing downwards (i.e., towards the ground and/or support surface).

Purely magnetic blocks (i.e., blocks only capable of joining other blocks via magnetic attraction), on the other hand, can be prohibitively expensive to acquire. This is because purely magnetic blocks typically require two or more magnets in each block to function, making them significantly more costly to produce than blocks comprised of only non-magnetic connection elements.

Magnetic blocks in the prior art have other deficiencies. For example, U.S. Pat. No. 9,662,592 discloses a block with a magnet for each side of the block. U.S. Pat. App. Pub. Nos. 2010/0120322, 2012/0309259 and 2012/0270465 allow each magnet to rotate to align the appropriate pole but do not allow sides to share the same magnet. U.S. Pat. App. Pub. No. 2017/0136381 discloses a block with a single large magnet. In addition to making the blocks costlier to manufacture, the multiple magnets or a single large magnet creates heavier blocks.

Furthermore, blocks exist containing non-magnetic connection elements as well as fixed magnetic connection elements (e.g., a Lego® block with a magnet positioned adjacent one of its faces). While these blocks allow for a combination of magnetic and non-magnetic connections, they are limited in orientation given the fixed nature of the magnet; namely, the block only adheres to a magnetically attractable surface via the face to which the magnet is adjacent.

Therefore, a building block capable of overcoming the deficiencies of the prior art is needed and desired. Specifically, a magnetic building block capable of providing a foundation for non-magnetic block structures without limitation to orientation of the magnetic building block relative to a magnetically receptive surface is needed.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention overcomes the limitations of the prior art by providing a block that contains a freely movable magnet(s) and is capable of providing a foundation for non-magnetic block structures. Structures built with the disclosed block of the present invention are less limited in orientation than traditional snapfit block structures, as they can be rotated 360 degrees on the same plane as, and/or 360 degrees out from, a magnetically attractable surface. Furthermore, they do not require a substantially horizontal underlying surface; rather, they may instead be positioned anywhere on a magnetically attractable surface (which, itself, may be at any angle or even vertical). Additionally, structures built using the disclosed block in conjunction with non-magnetic snapfit blocks can be significantly cheaper than structures built entirely with magnetic blocks.

Generally, the block of the present invention comprises a polyhedral body containing one or more cavities. A freely movable magnet resides within each cavity. The magnet can be of any shape, so long as it can move about the cavity and arrive at any number of predetermined resting spots, whereby it can "pin" the block to an external magnetically attractable surface. The magnetic pull-force from the block is at least as strong as is needed to "pin" the block against the magnetic surface without the block slipping undesirably. When a user changes the block's orientation relative to the magnetically attractable surface, the magnet(s) realign themselves to "pin" the block in that new orientation.

At least one face of the block contains a non-magnetic connection element, (i.e., a connection apparatus to which non-magnetic items may be attached). Such connection elements may include, but are not limited to, the "snapfit" elements found on Lego®, and Duplo®-style blocks. The face containing the non-magnetic connection element may be comprised of a "male" snapfit element (i.e., the studs comprising the element protrude out from the block) and/or a "female" element (i.e., holes or indents that protrude into the block capable of receiving a male element).

Where a block face contains a "female", or inwardly protruding snapfit element, the block's cavity(ies) is shaped to allow the magnet(s) to reside in between the inwardly protruding studs that comprise the female snapfit element. This allows the internal magnet to achieve a close enough proximity to a magnetically attractable surface for that face to serve as the magnetic connection plane. When positioned in between the studs, the magnet does not compromise the functionality of the female snapfit element.

Where a block face contains a "male" or "convex" snapfit element, (i.e., the snapfit element protrudes out from the block), the face may contain an opening into the cavity (hereinafter, a magnet protrusion hole), through which a portion of the magnet may protrude. When extended into the opening, the magnet's proximity to the magnetically attractable surface is at least as close as is necessary to sustain the block on the surface through that face. The magnet protrusion hole may be covered by a magnet protrusion hole cover in order to hide the magnet from view from outside the block, as well as to prevent debris, et al. from entering the block.

The disclosed invention carries many benefits, including, but not limited to: (i) the ability to serve as a foundation for structures of magnetic and non-magnetic blocks that extend from the disclosed magnetic block; (ii) the ability to change the orientation of the disclosed block—and any block structure attached to it—by changing which face or edge of the disclosed block is currently adhered to the magnetic surface. Note that in many instances, a user need not dismantle the structure before changing its orientation relative to a magnetically attractable surface; (iii) the ability to rotate the disclosed block and any block structure attached to it up to 360 degrees on a surface to which it is magnetically adhered to; (iv) the ability to rotate the disclosed block up to 360 degrees out from a surface to which it is magnetically adhered to; (v) the ability to create multiple magnetic connection surfaces with a single magnet; (vi) the ability for a block side to serve as a magnetic connection surface without compromising its functionality as a "female" connection element; (vii) the ability for a block side to serve as a magnetic connection surface despite containing "male", or convex connection elements; (viii) the ability of the block to adhere to a magnetically attractable surface via one of its edges, rather than just of its faces; (ix) the ability of the block to adhere to a magnetically attractable surface via each of its faces and edges; (x) the ability to limit undesirable rotational movement of the disclosed block and attached structures by providing contact points between the block and the magnetic surface that are near the perimeter, rather than the middle, of the block's sides; (xi) the ability of the interior cavity to channel or steer the magnet to an area adjacent the approximate centers of each outer face, ensuring that the magnet's pull-force is optimally positioned for a balanced magnetic hold; (xii) the ability of the female connection element to effectively accommodate and hold both large (e.g. Duplo®) and small (e.g. Lego®) male connection elements; and (xiii) the ability to hide an internal magnet from view from a magnet protrusion hole by utilizing a flexible magnet protrusion hole cover.

To accomplish these objectives, the present invention provides a construction or building block comprising: a plurality of sides coupled together to form a substantial enclosure, each side having an inner surface and an outer surface; an inner cavity formed within the enclosure; a magnetic member having a first diameter and located within the inner cavity, the magnetic member being freely movable within the inner cavity; and an aperture having a second diameter and extending from the inner cavity through one of the plurality of sides; wherein the magnetic member is capable of partially extending through the aperture.

In another aspect, the present invention provides a construction or building block comprising: a plurality of sides integrally formed together to form a substantial enclosure, each side having an inner surface and an outer surface; a magnetic member located within the enclosure, the magnetic member being freely movable within the enclosure; and an aperture extending from the enclosure through one of the plurality of sides; wherein the magnetic member is capable of partially extending through the aperture.

In yet another aspect, the present invention provides a construction or building block comprising: a plurality of sides integrally formed together to form a substantial enclosure, each side having an inner surface and an outer surface; an inner cavity formed within the enclosure, the inner cavity having a wall; and a magnetic member located within the inner cavity, the magnetic member being freely movable within the inner cavity.

BRIEF DESCRIPTION OF THE SEVERAL VIEWS OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

Figure 1:
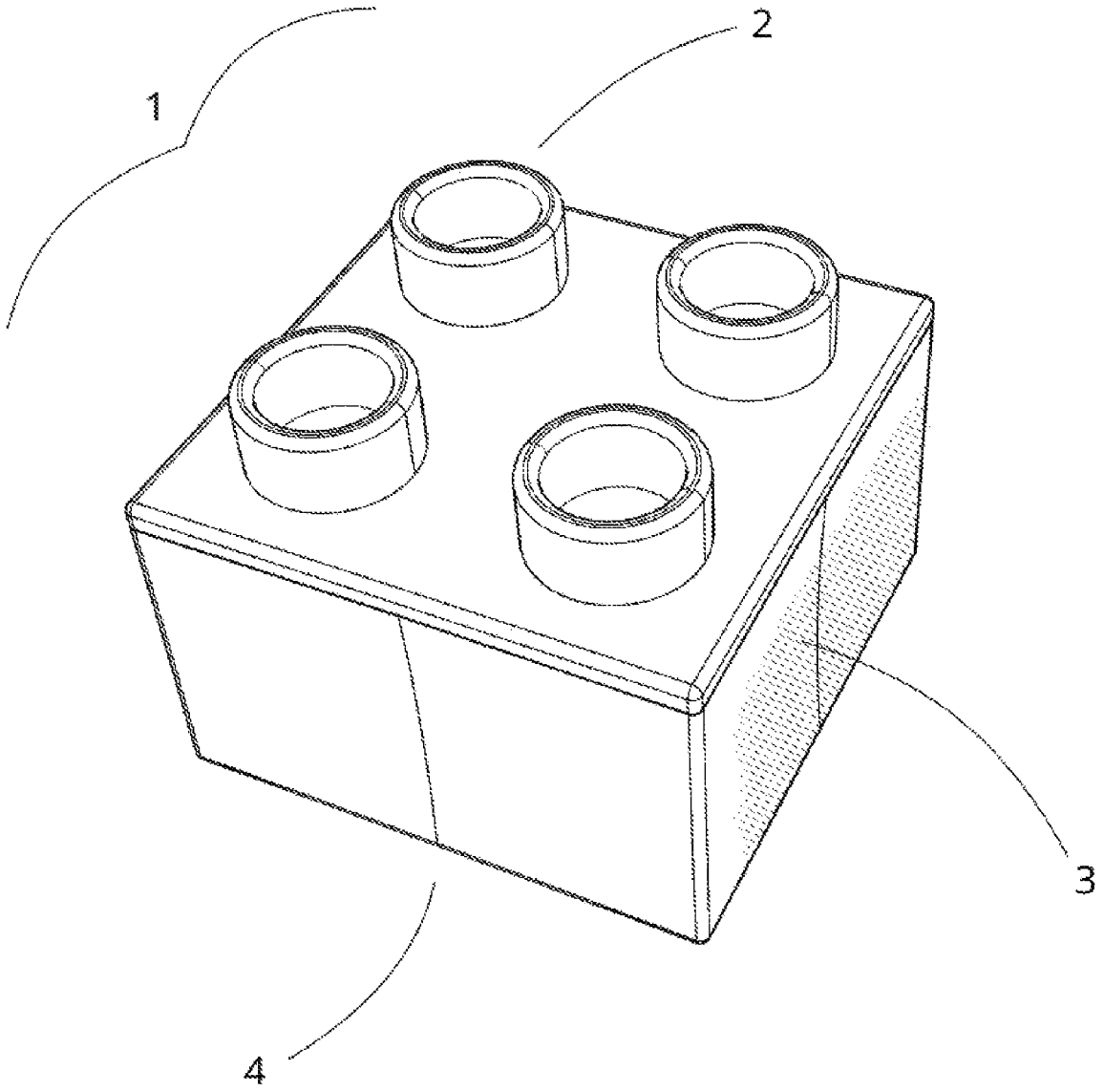
FIG. 1 shows a perspective view of an embodiment of the present invention featuring a "male" snapfit connection element on one face.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Referring to the figures, several embodiments of the building block of the present invention are shown. The embodiments show the building block in configurations for use with "small-style" building blocks (e.g., Lego®) as well as large-style blocks (e.g., Duplo®). As well, shown in the figures are inventive features of the present invention including, but not limited to, various embodiments of the internal cavity and the magnetic protrusion hole. The embodiments shown are for purposes of illustration and not to be in any way limiting.

Referring to FIGS. 1-4, an embodiment of the disclosed block (1) is shown. In this embodiment, the block (1) includes four "male"/convex snapfit elements (2) capable of pairing with the "female"/concave connection element of certain large-style snapfit blocks, (e.g., Duplo®, etc.), as well as certain small-style blocks (e.g., Lego®, etc.). In this embodiment, the internal stand-alone magnet (8) can align itself with each of the four block sides (3), the block's underside (4), or the block's edges.

Figure 3:
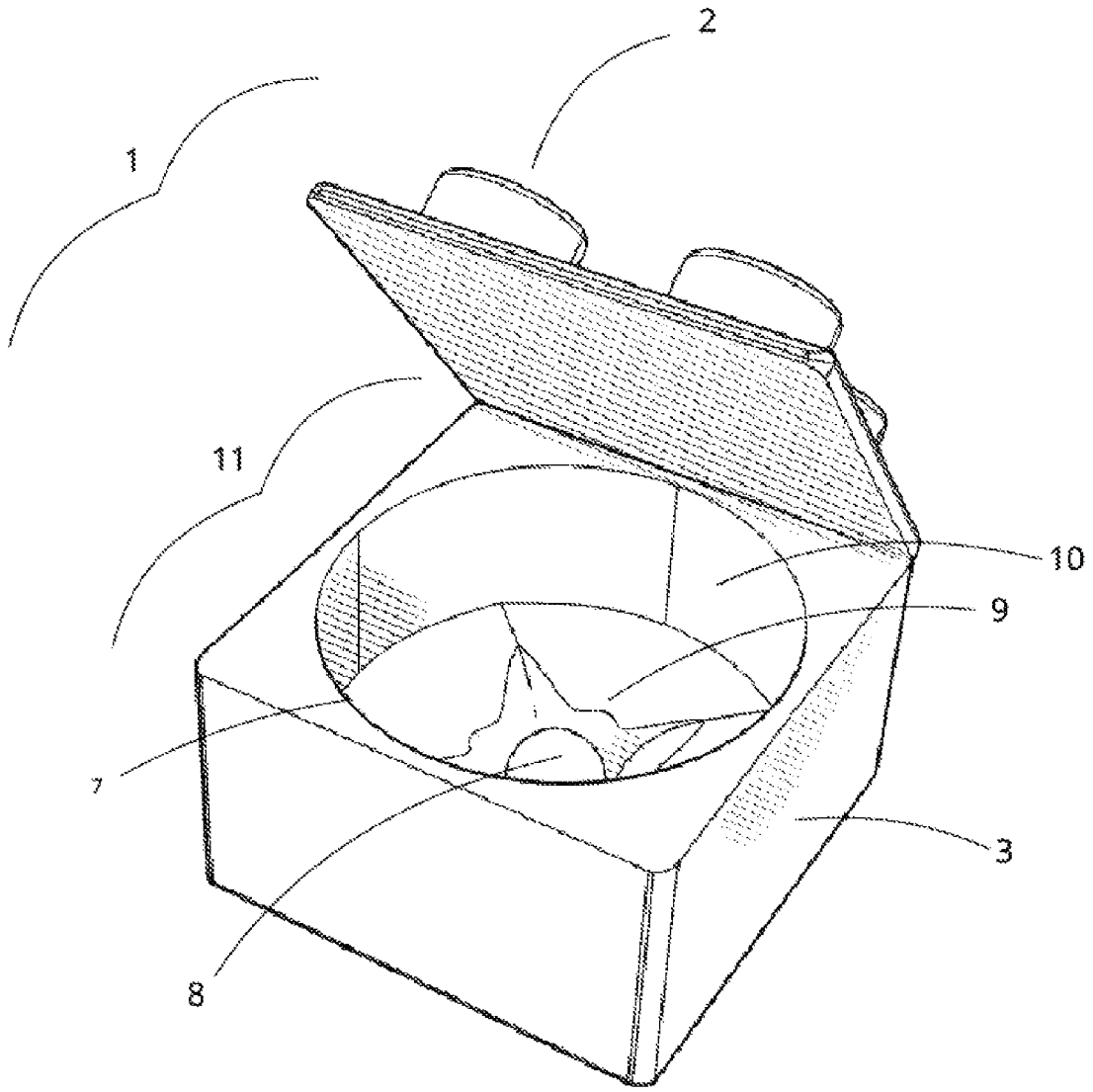
FIG. 3 shows a perspective view of the block of FIG. 1 with its top partially removed and its interior cavity visible for illustration purposes.
Figure 4:
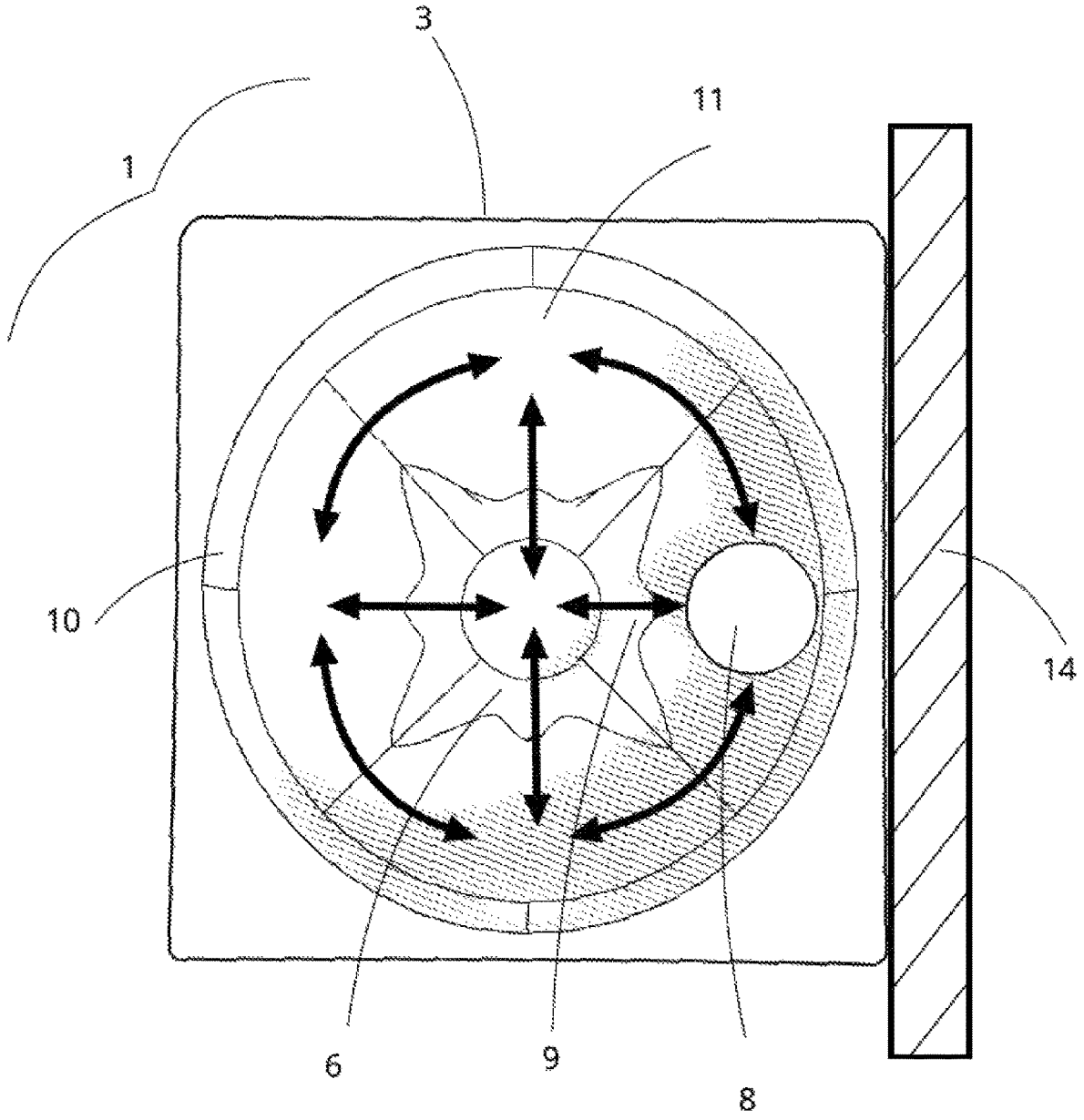
FIG. 4 shows a plan view of the block of FIG. 1 with its top removed, for illustration purposes, and its internal magnet visible proximate a magnetically attractable surface, with arrows indicating the magnet's potential travel paths should the block be rotated.

As shown in FIGS. 3-4, the block (1) includes a plurality of sides (3) with surfaces, and an internal stand-alone magnet (8), which can be made of a permanent magnet or a ferromagnetic material. Although one stand-alone magnet (8) is shown here, a plurality of stand-alone magnets could be included. The contained stand-alone magnet (8) may assume many shapes (sphere, disc, cube, etc.). In the preferred embodiment, however, the stand-alone magnet (8) is spherical, allowing it to roll easily about the cavity as the block (1) is rotated. The stand-alone magnet (8) is freely movable within the block (1). In alternative embodiments, at least one, or even all, of the surfaces of at least one of the sides may be composed of or implanted with magnetic material.

Referring to FIGS. 3 and 4, the inner or internal cavity (11) of the block (1) is shown. FIG. 3 shows the disclosed block (1) with its top side removed and the internal cavity (11) visible. Note that this is for illustration purposes only, as the block (1) and cavity (11) would normally remain sealed off to the user. The internal cavity (11) is integrally formed with the block (1) and is comprised of the cavity walls (10), the internal stand-alone magnet (8), and the cavity floor (7). While the cavity floor (7) may assume many shapes, the cavity floor (7) in the preferred embodiment contains indents, grooves or channels (9) that facilitate the movement of the internal stand-alone magnet (8) between the column or shaft (6) and the portions of the cavity walls (10) adjacent to the central portion of the block's outer sides (3). Note that the grooves' or channels' (9) depth and width are dictated in part by the space requirements of the "female"/concave connection element located beneath the cavity floor (7). The cavity floor (7) serves to prevent the internal stand-alone magnet (8) from falling out of the disclosed block (1). In the preferred embodiment, the cavity floor (7) is elevated enough to accommodate the "male"/convex element portion of a connected block(s). The cavity floor (7) is low enough, however, to avoid impeding the free movement of the stand-alone magnet (8), i.e., unimpeded, contained within the cavity (11). In the alternative, the cavity floor (7) could be provided with an aperture extending therethrough so that the stand-alone magnet (8) is at least partially exposed.

As shown in FIGS. 3 and 4, the cavity wall (10) can take any number of shapes. In one embodiment, however, its cylindrical shape allows the stand-alone magnet (8) to roll smoothly from block face to block face as the block (1) is rotated. The cavity wall's (10) height is tall enough for the stand-alone magnet (8) to roll without interference by either the cavity ceiling or the cavity floor (7). The minimum distance between the cavity wall (10) and the outer side (3) occurs at substantially the center of each outer side (3), ensuring that the magnetic pull force is the located adjacent the approximate centers of each outer side. Having the stand-alone magnet (8) position itself adjacent the centers of the outer sides (3) ensures that the pull-force of the stand-alone magnet (8) will distribute evenly across the selected side (3). To illustrate this, FIG. 4 shows a top-down view of the disclosed block (1) with its top removed and the cavity (11) and stand-alone magnet (8) visible; the stand-alone magnet (8) in this instance having been pulled toward a magnetically attractable surface (14). Arrows indicate some potential paths for the stand-alone magnet (8) travel should the block (1) be rotated. Of particular note, arrows extending from the center cylinder, column or shaft (6) to the block's sides (3) demonstrate the block's use of grooves or channels (9) to efficiently transition the stand-alone magnet (8) from the cylinder, column or shaft (6), through the paths created in accordance with the female connection element, to substantially the center of the block's sides (3).

Figure 6A:
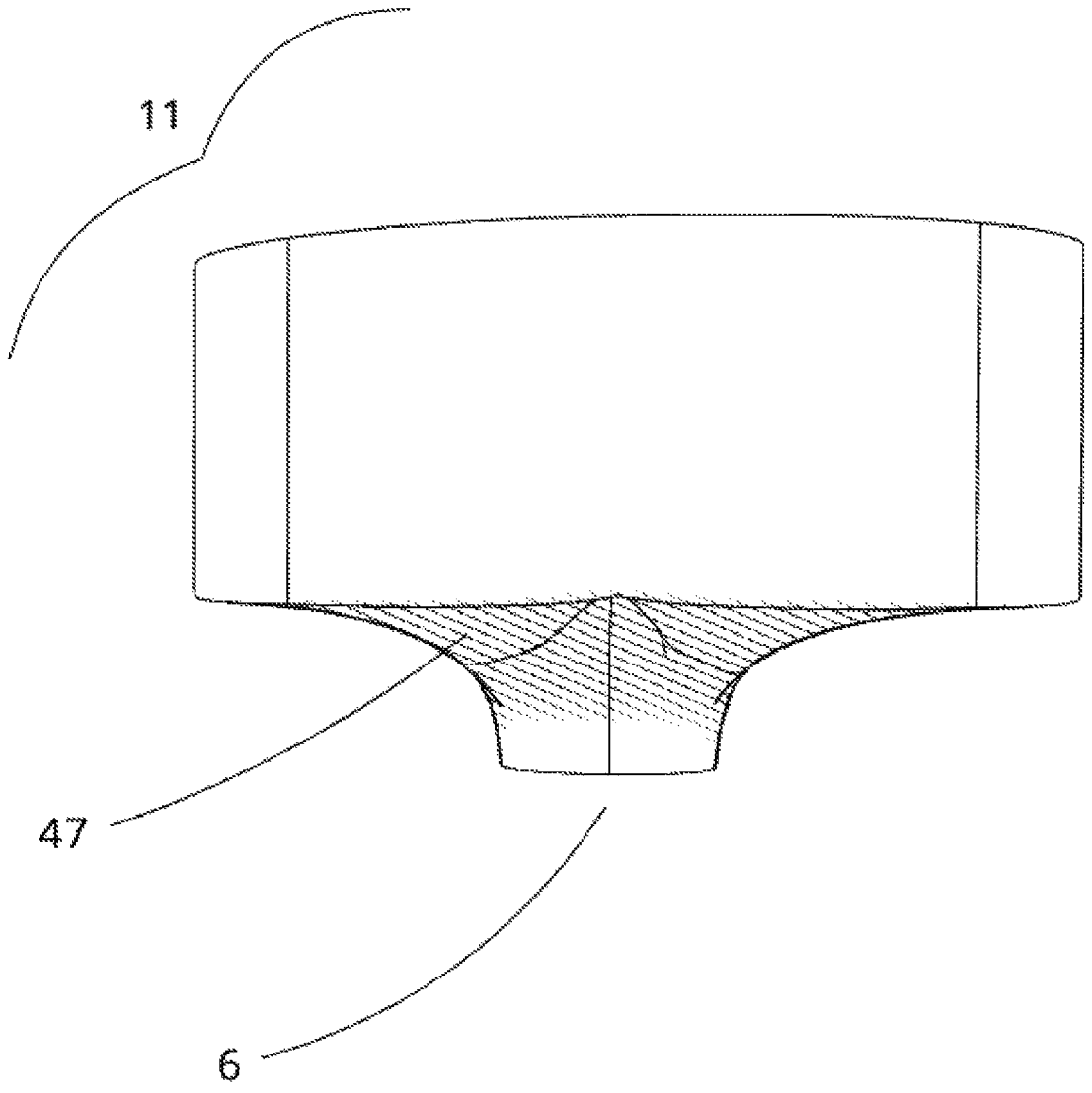
FIG. 6A shows a side view of an embodiment of an internal cavity of the block of the present invention.

Referring to FIGS. 6A-6E, the internal cavity (11) could take on several forms. FIG. 6A shows a profile/side view of one embodiment of the disclosed block's internal cavity (11), with a substantially funnel-like shape (47) narrowing into the cylinder or column (6) surrounded by alternating channels (9) and indents (48). The funnel-like shape serves to transition the interior magnet (8) towards the center of the bottom of the disclosed block.

Figure 6B:
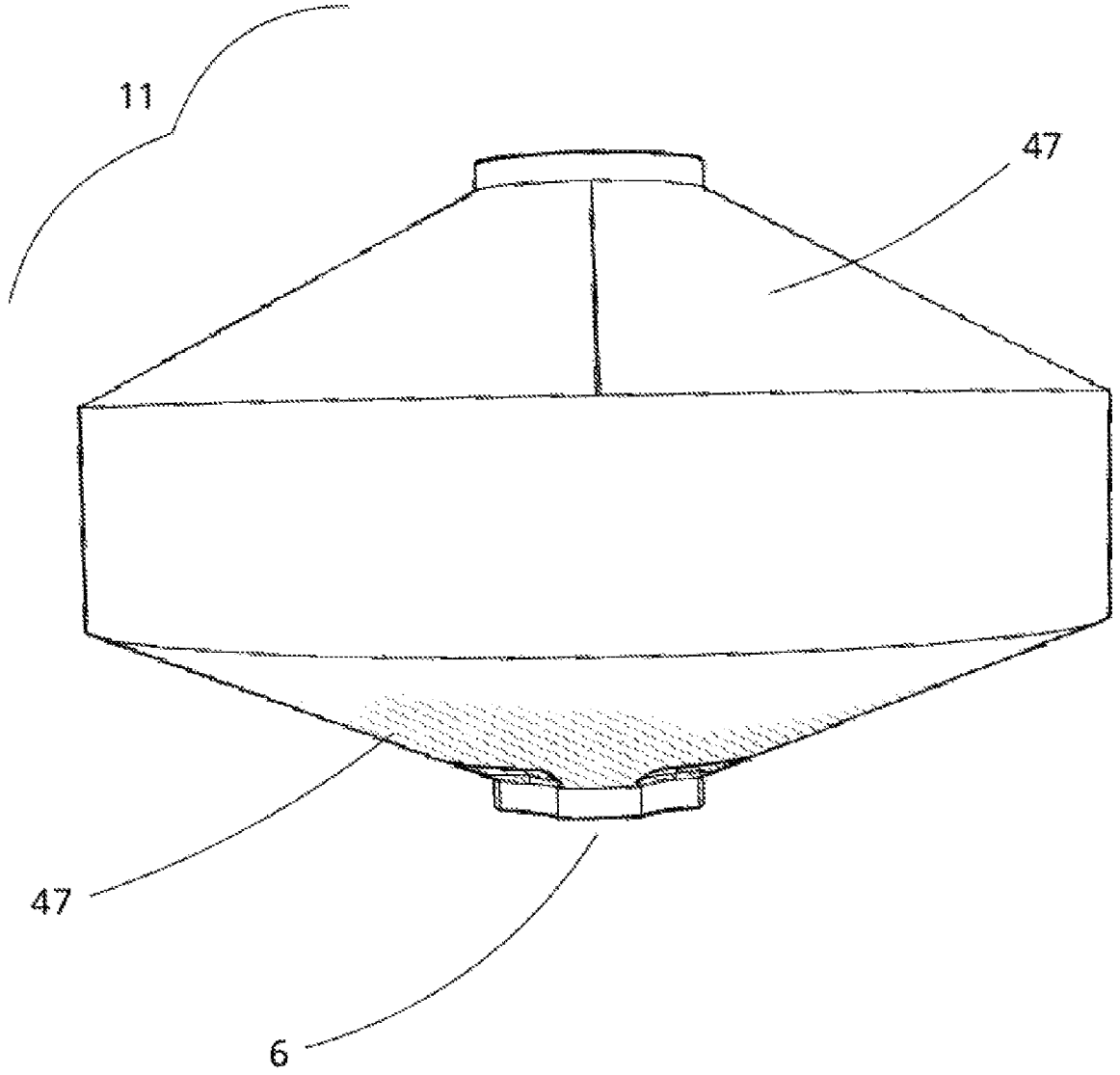
FIG. 6B shows a side view of another embodiment of an internal cavity of the block of the present invention.
Figure 6C:
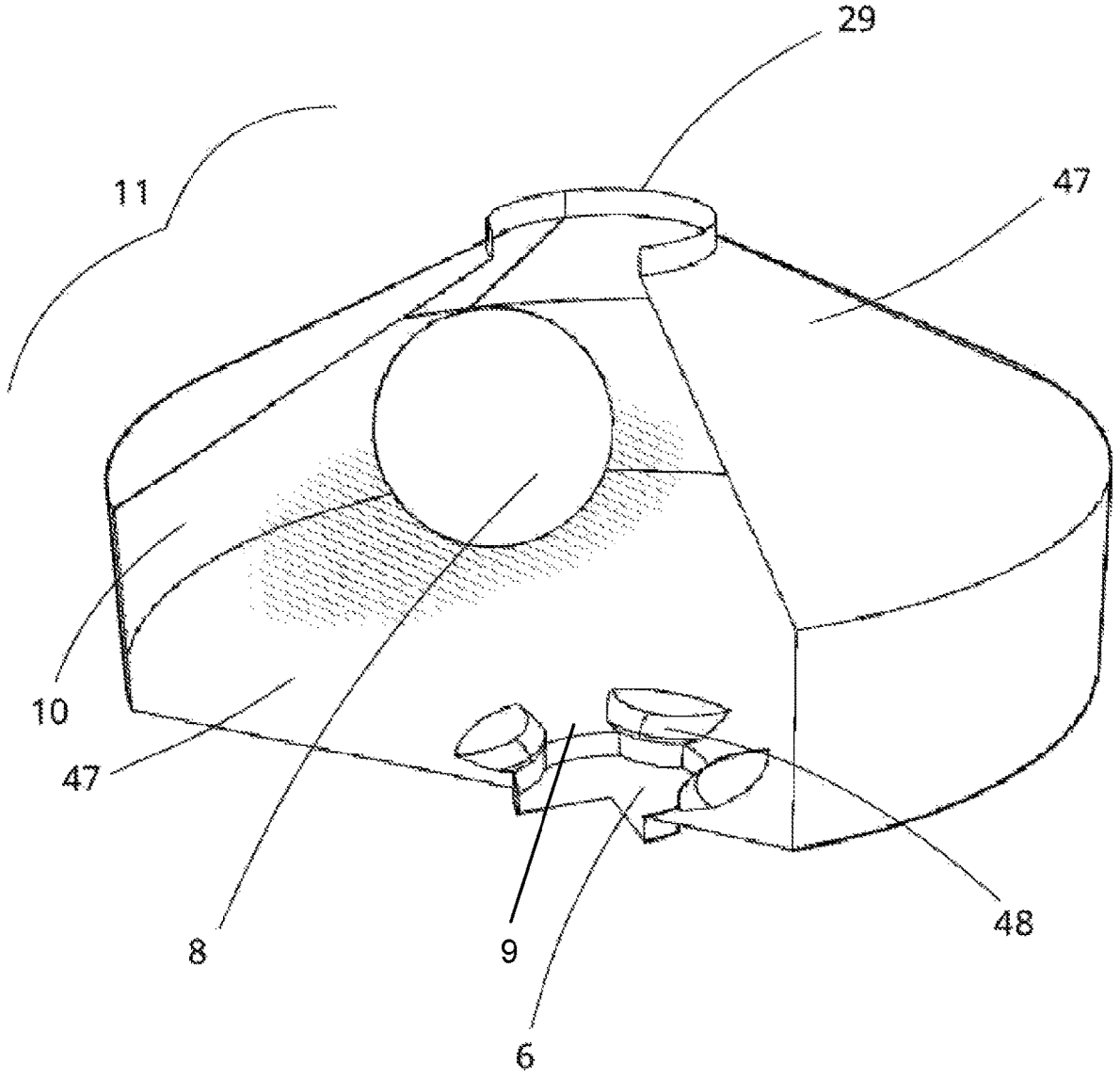
FIG. 6C shows a perspective view of the internal cavity as embodied in FIG. 6B, a front quarter of the cavity having been removed, for illustration purposes, to show the cavity's interior and contained magnet.

FIGS. 6B and 6C show an alternative embodiment of the block's internal cavity (11) with two funnel shaped portions (47). The topmost funnel serves to channel an internal stand-alone magnet (8) towards the center top of the block (1). The bottommost funnel serves to channel an internal stand-alone magnet (8) towards the center bottom of the block (1). The magnet protrusion hole (29) near the top of the cavity (11) allows only a portion of the internal stand-alone magnet (8) to protrude through. Female connection element indents around the column or shaft (6) are used as needed to allow for a female connection element on the side of the block containing the column or shaft (6). While indents are formed on an underside of the block (1) for the female connection element, corresponding protrusions (48) are formed on an opposing side, i.e., the inner surface of the internal cavity (11). The column or shaft (6) is formed below a lower aperture (6*a*) such that a space (6*b*) is formed within the column or shaft (6).

Figure 5B:
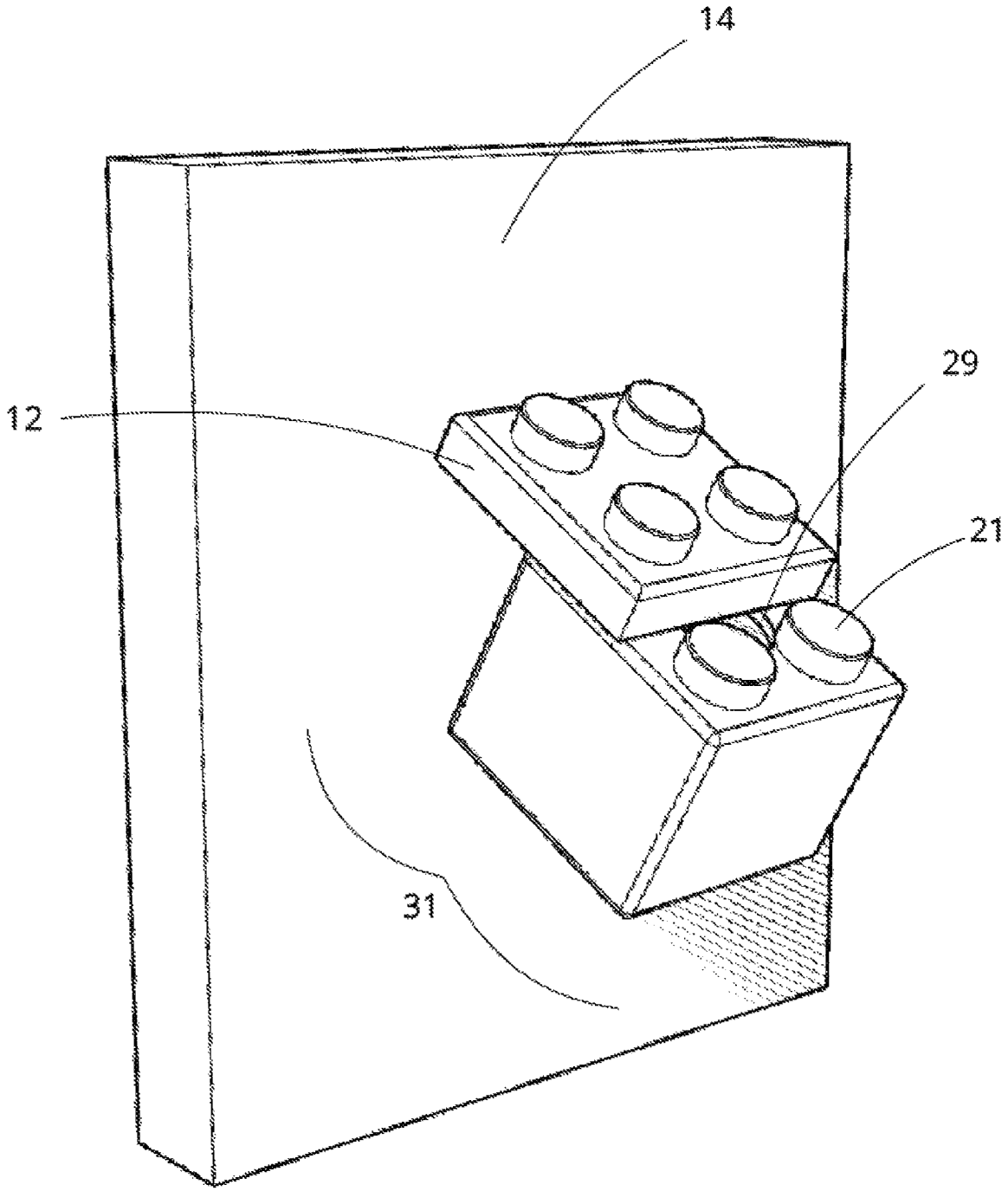
FIG. 5B shows another embodiment of a block of the present invention (and attached non-magnetic block) adhered to a magnetically attractable surface via one of the disclosed block's edges.
Figure 6D:
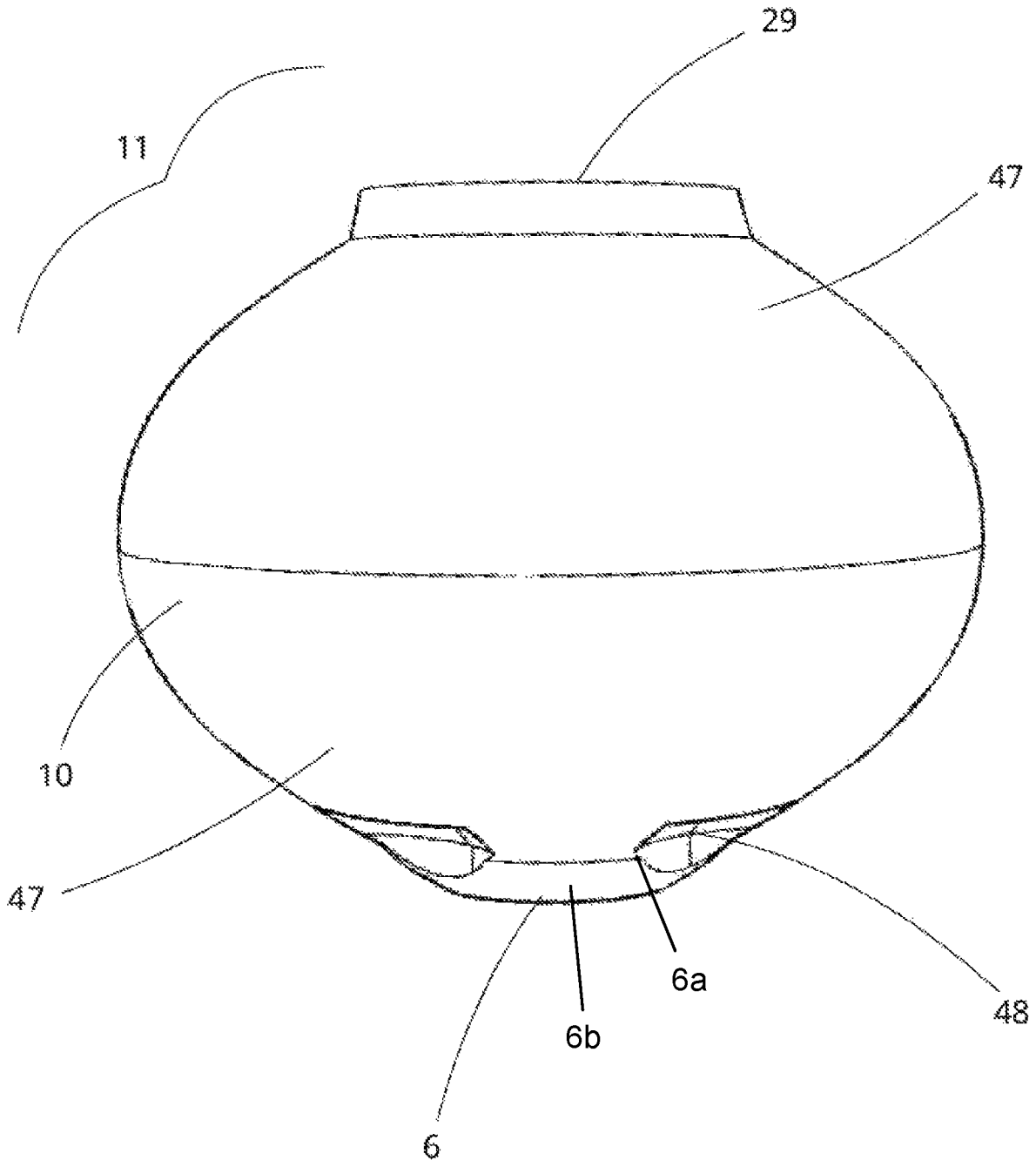
FIG. 6D shows a side view of another embodiment of an internal cavity of the block of the present invention.
Figure 6E:
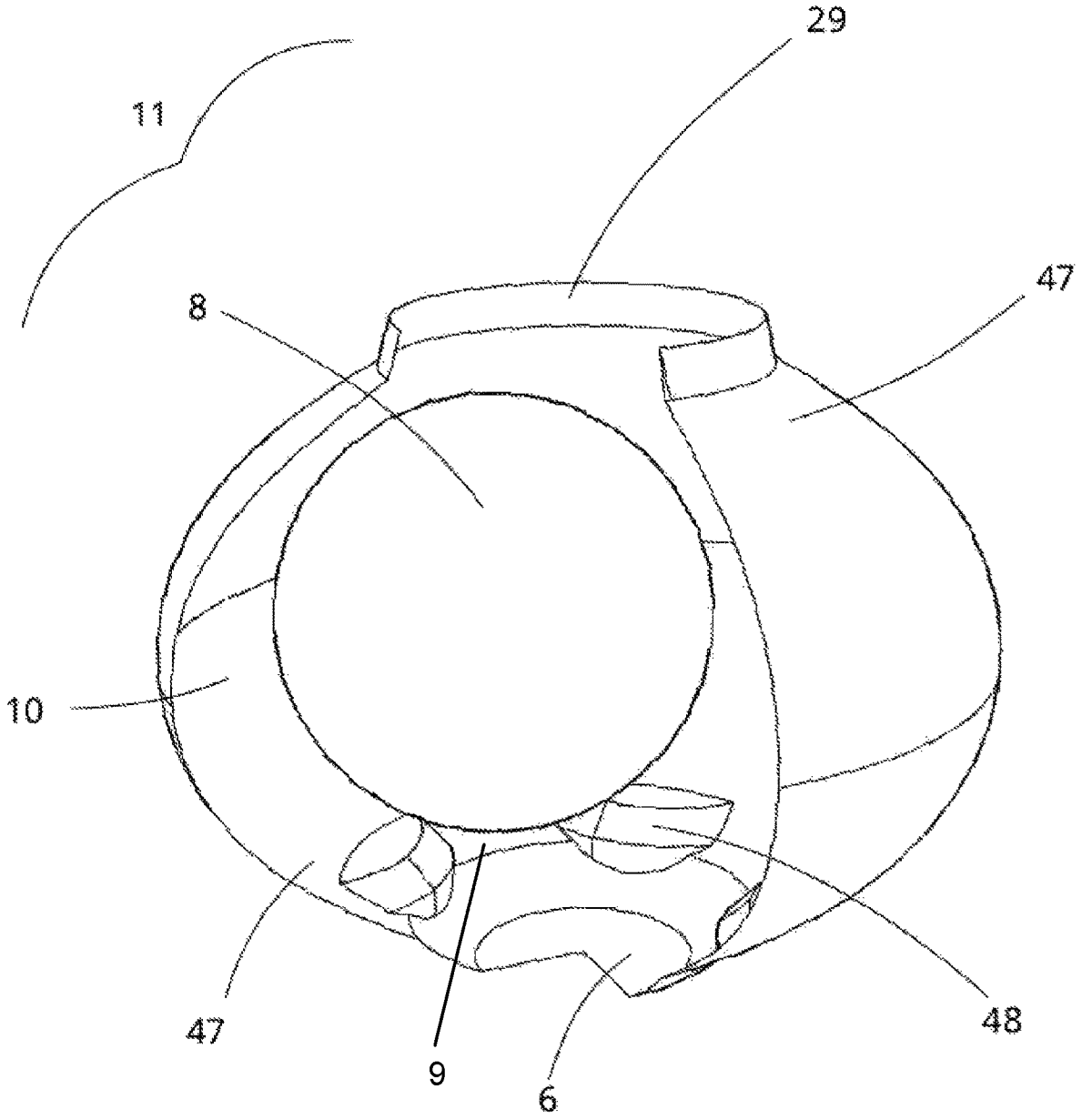
FIG. 6E shows a perspective view of the disclosed internal cavity as embodied in FIG. 6D, a front quarter of the cavity having been removed, for illustration purposes, to show the cavity's interior and contained magnet.

FIGS. 6D and 6E show another embodiment of the internal cavity (11). In this embodiment, the cavity (11) is more rounded, allowing the internal stand-alone magnet (8) to better reside adjacent to the disclosed block's (1) outer edges (rather than just its sides). This allows the block (1) to better adhere to magnetically attractable surfaces via its edges (as depicted in FIG. 5B).

The internal cavity (11) could be integrally formed with the sides (3) of the block (1) or could be independently formed within the block (1). That is, a space between the cavity (11) and the sides (3) could be solid with material, e.g., plastic or rubber, or open.

Referring to FIGS. 2, 11A, 12A and 13, an underside (4) of the disclosed block (1) is shown. Specifically, a female snapfit element of one embodiment of the disclosed block (1) capable of attaching to the male connections of both large and small-style blocks is shown. As described above and shown in FIG. 13, the movement of the internal stand-alone magnet (8) between the block's column (6) and the cavity walls (10) is facilitated by channels (9) and indents (48). The channels (9) are comprised of groove-like elements or one or more valleys (27) and ridges (28). The valleys (27) and ridges (28) of each channel (9) serve to reduce friction exerted on the stand-alone magnet (8) by the block (1) while also allowing for ample air movement around the magnet (8). That is, the groove-like elements prevent the stand-alone magnet (8) from "sticking" to that portion of the block (1). The channels (9) serve to steer the stand-alone magnet (8) to the outer portions of the cavity wall (10) adjacent to the center area of the block's outer sides (3), ensuring that the magnetic pull force is optimally located near the center of each outer side.

Figure 11A:
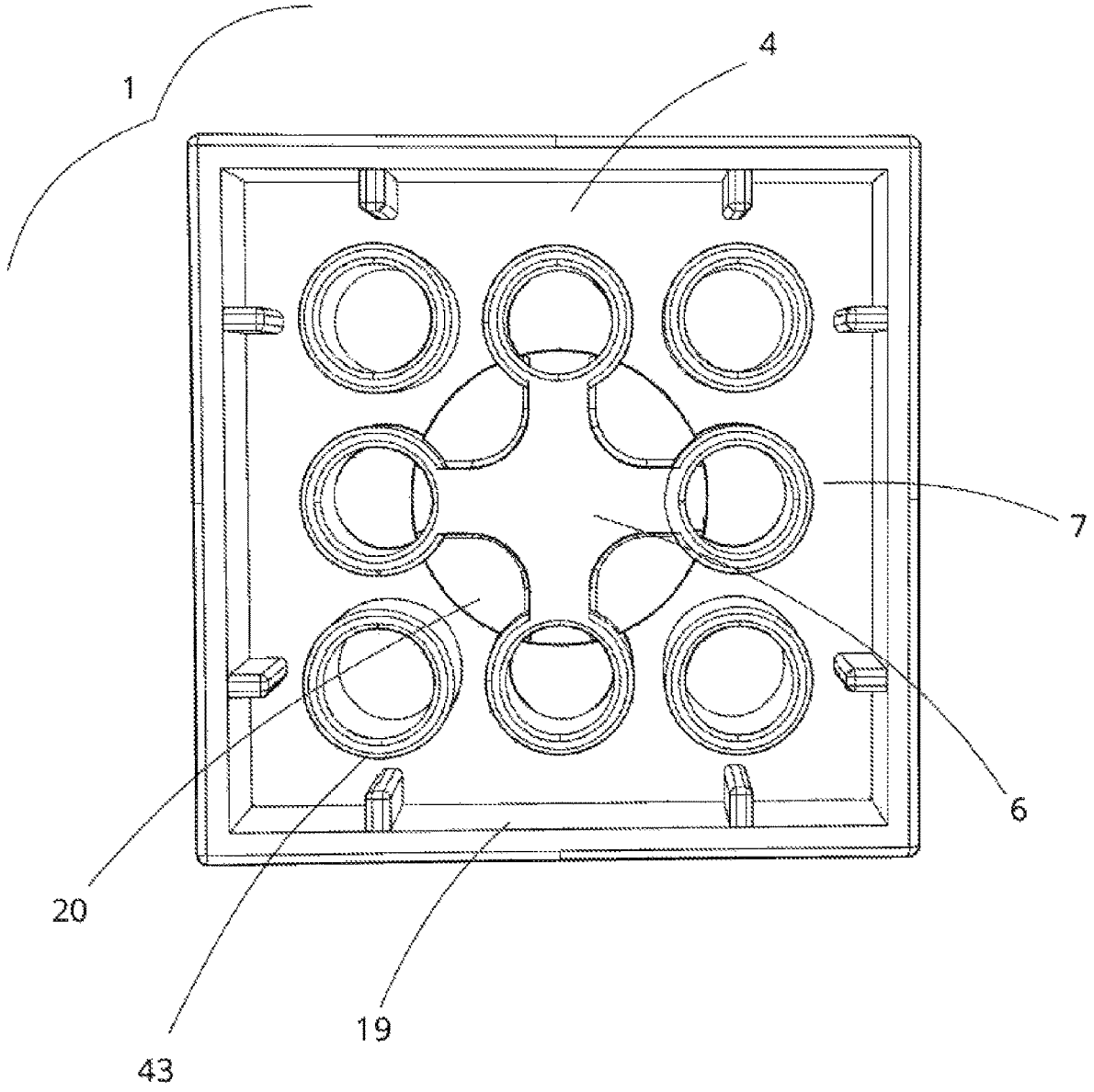
FIG. 11A shows bottom plan view of the block of FIG. 2 with a "female" snapfit connection element on one face.
Figure 11B:
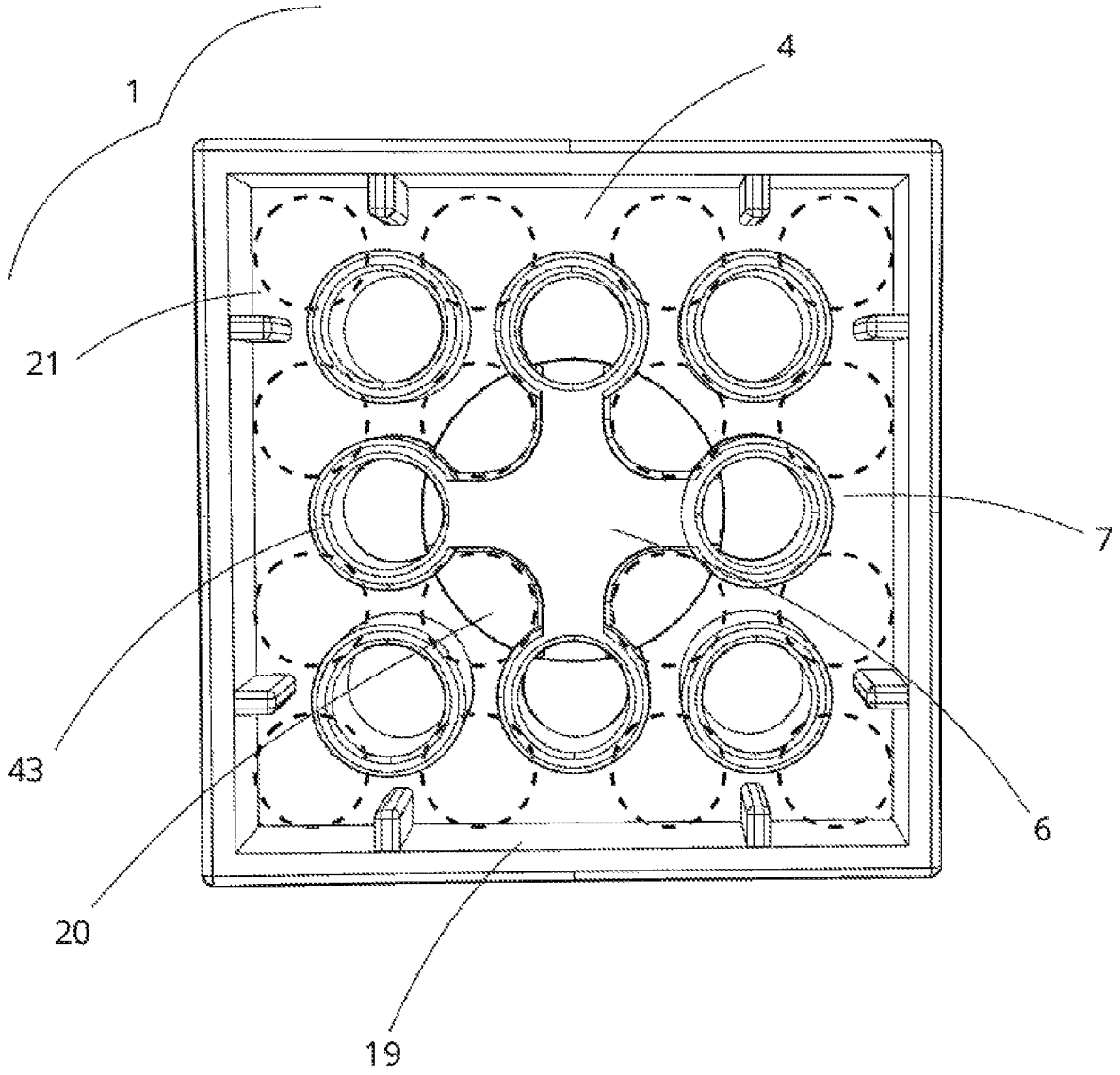
FIG. 11B shows the disclosed block of FIG. 11A with dashed lines depicting potential locations for attaching the "male" snapfit elements of small-style blocks (e.g., Lego®).
Figure 11C:
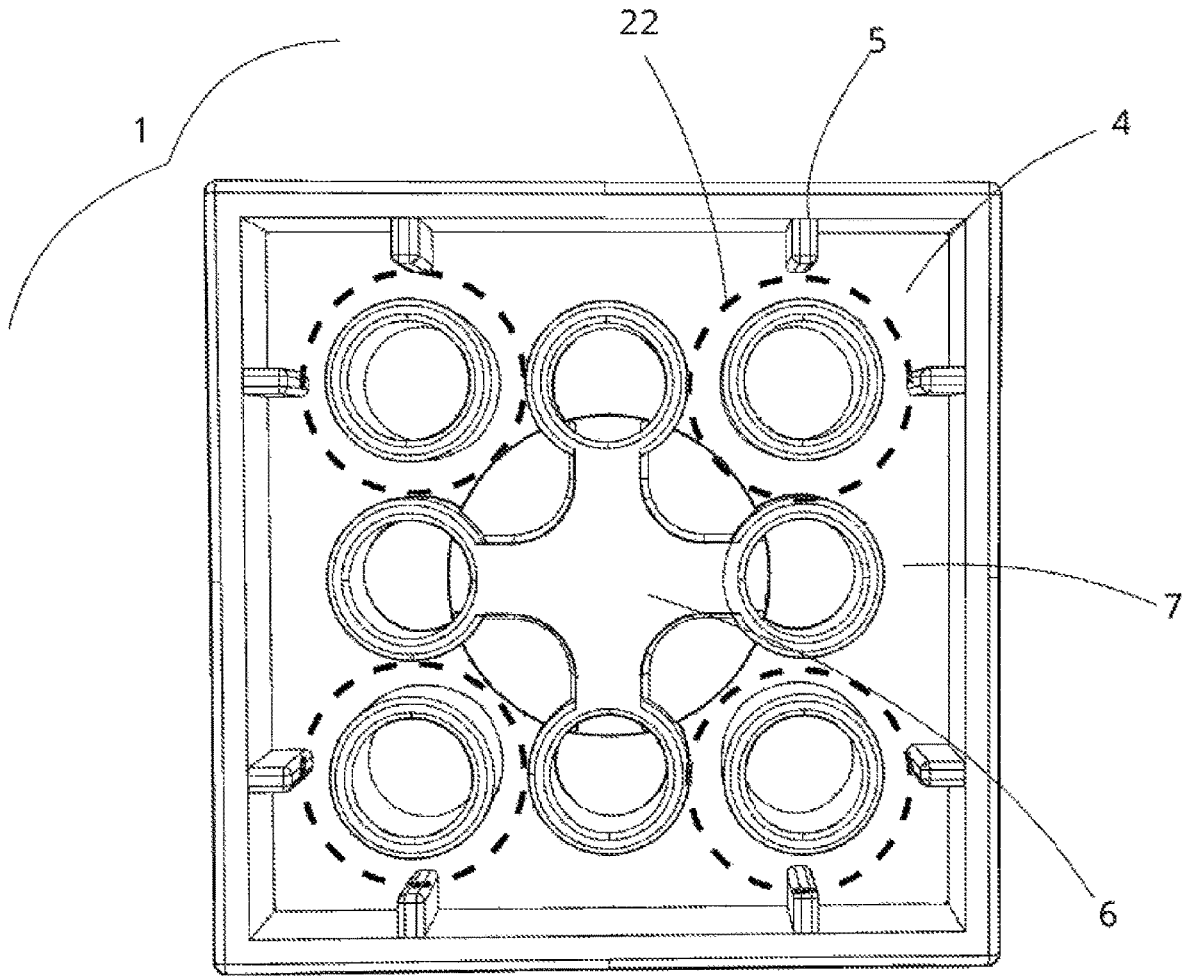
FIG. 11C shows the disclosed block of FIG. 11A with dashed lines depicting potential locations for attaching the "male" snapfit elements of large-style blocks (e.g., Duplo®).

As seen in FIGS. 2, 9, 11C and 12C, when the "male"/convex snapfit element (22) of a large-style block (e.g., Duplo®) (26) is "snapped" into the underside (4) of the disclosed block (1), each male element is enclosed around a respective wall shaft (43) such that the wall protrusions (5) and central column or shaft (6) work in concert to engage and squeeze the protruding studs that comprise the male element, thereby holding the two blocks together. FIG. 11C shows the female snapfit element of the disclosed block (1).

Figure 9:
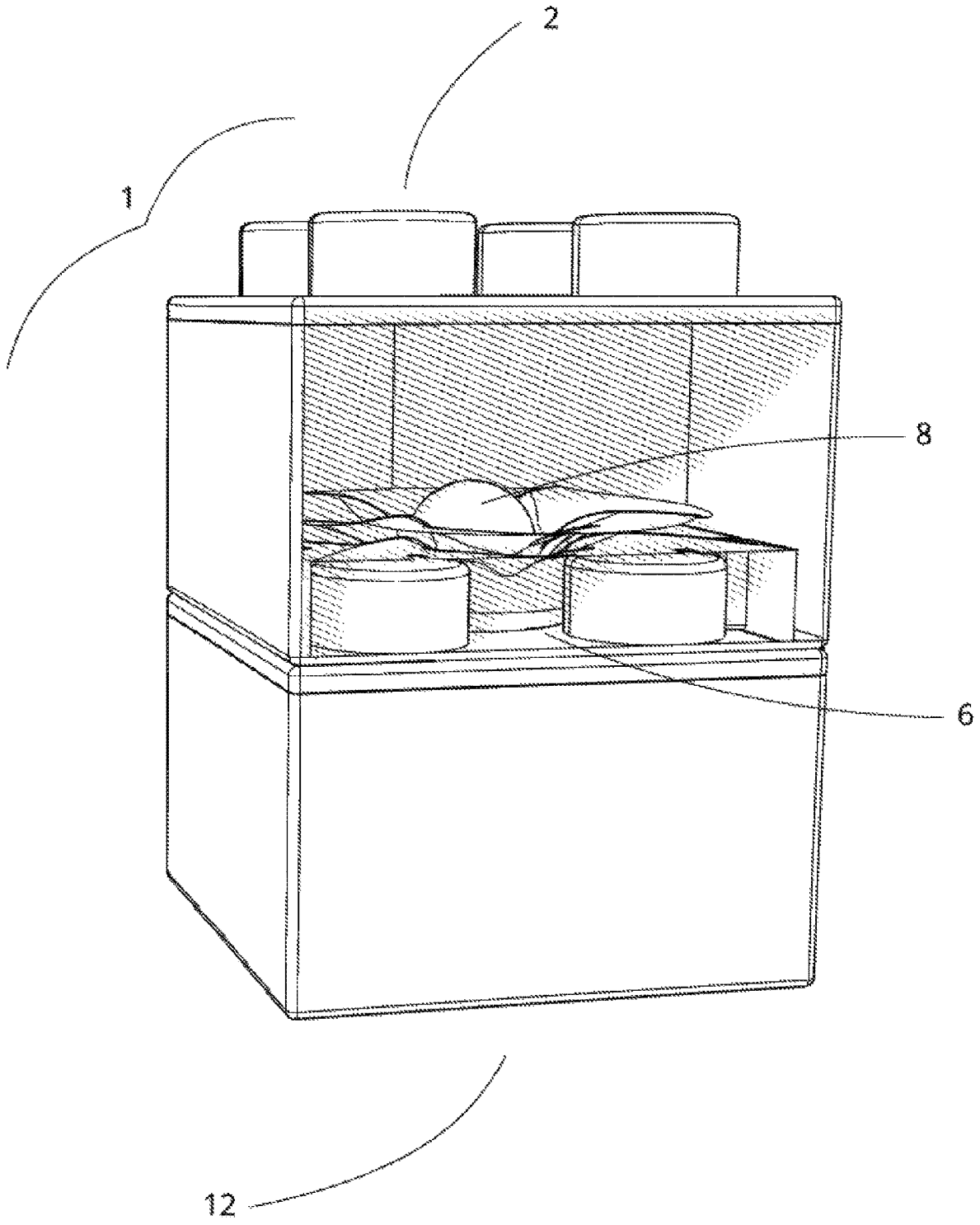
FIG. 9 shows a perspective view of the disclosed block of FIG. 1 connected via snapfit elements to a non-magnetic snapfit block. A side face of the disclosed block has been removed for illustration purposes in order to show the internal magnet "nestled" in between the studs comprising the "male" snapfit connection element of the bottom block.

Dashed lines (22) serve to demonstrate the potential locations of the male studs of an attached, large-sized, non-magnetic, snapfit block (Duplo®, etc.). The disclosed block (1) holds the non-magnetic snapfit block in place by squeezing its male studs (22). The squeezing is brought about by a combination of pressures exerted on the studs by the block's central column or shaft (6), and wall protrusions (5). Thus, the components (5), (6), (43) of the underside (4) comprise the "female"/concave snapfit connection element of the block (1) in this configuration. As shown in FIG. 9, the stand-alone magnet (8) is seen residing in between the "male" connection element studs on the non-magnetic block (12) without adversely affecting the snapfit connection between the two blocks. As well, as shown in FIG. 12C, the block's female snapfit element connects with the male snapfit element (22) of a non-magnetic, large-style block (26) without affecting the other components of the block (1).

Figure 2:
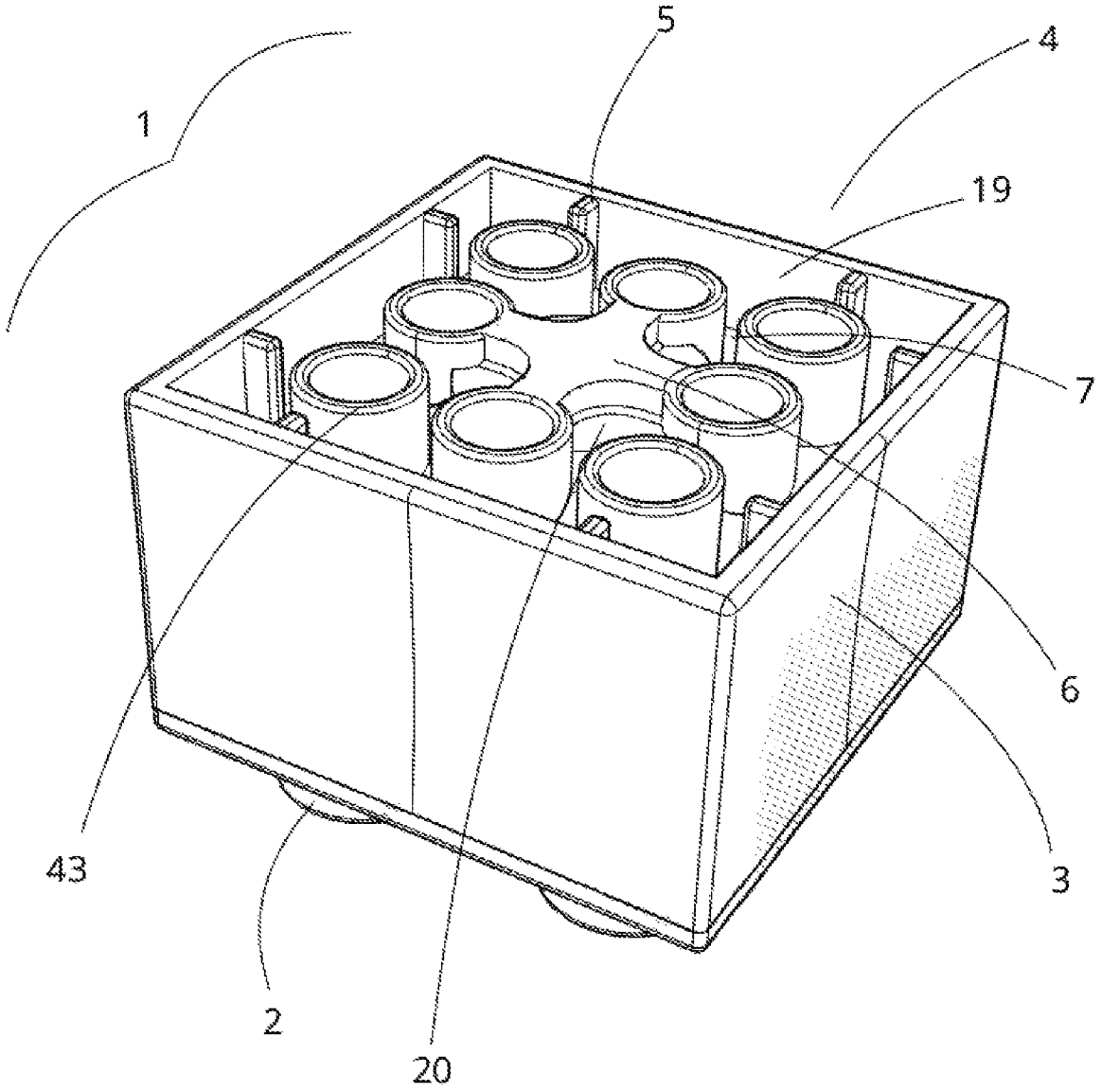
FIG. 2 shows a perspective view of the block of FIG. 1 featuring a "female" snapfit connection element on one face.
Figure 12A:
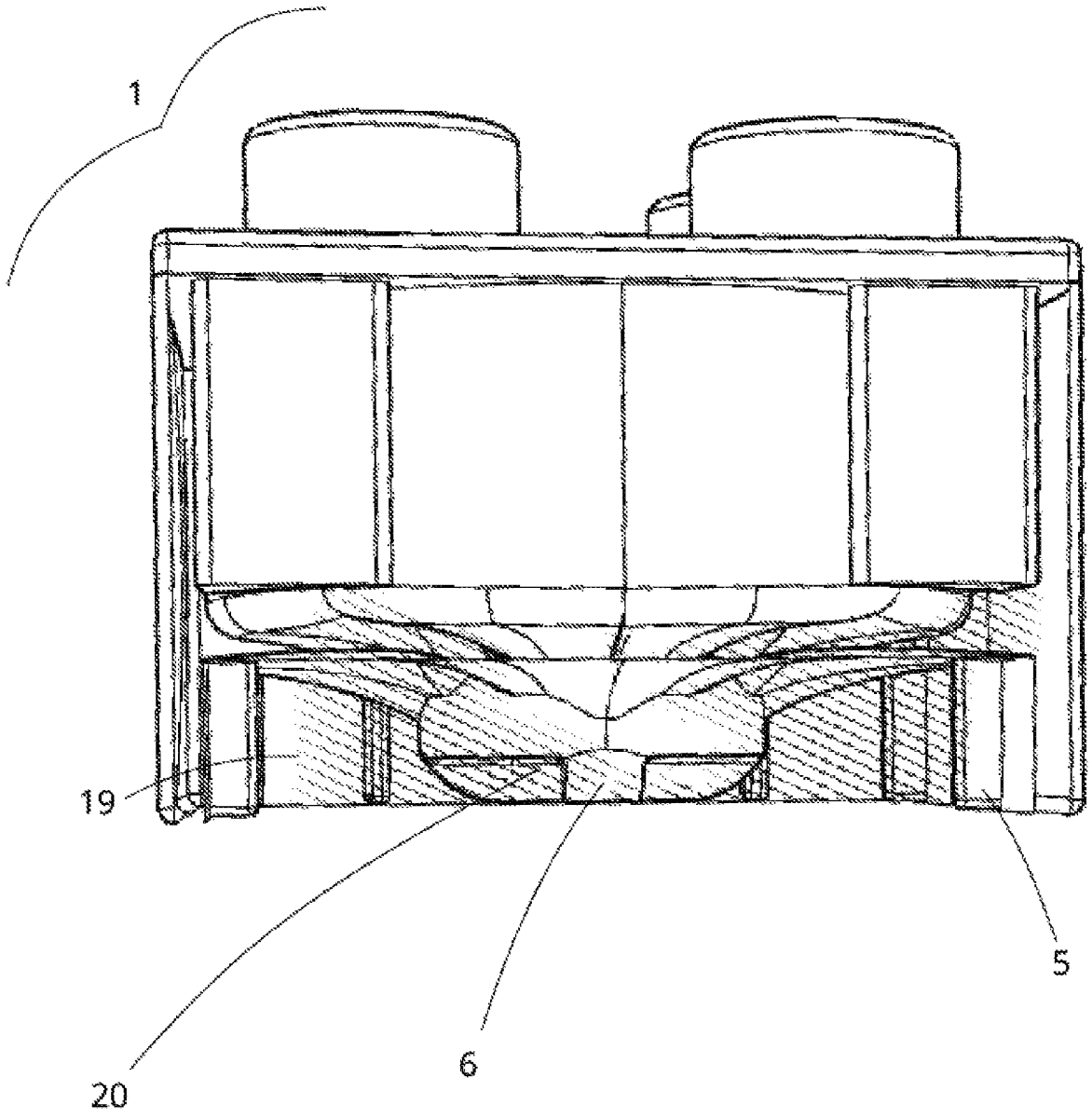
FIG. 12A shows a side view of an embodiment of the block of the present invention with one face removed for illustration purposes to show the "female" snapfit element.
Figure 12B:
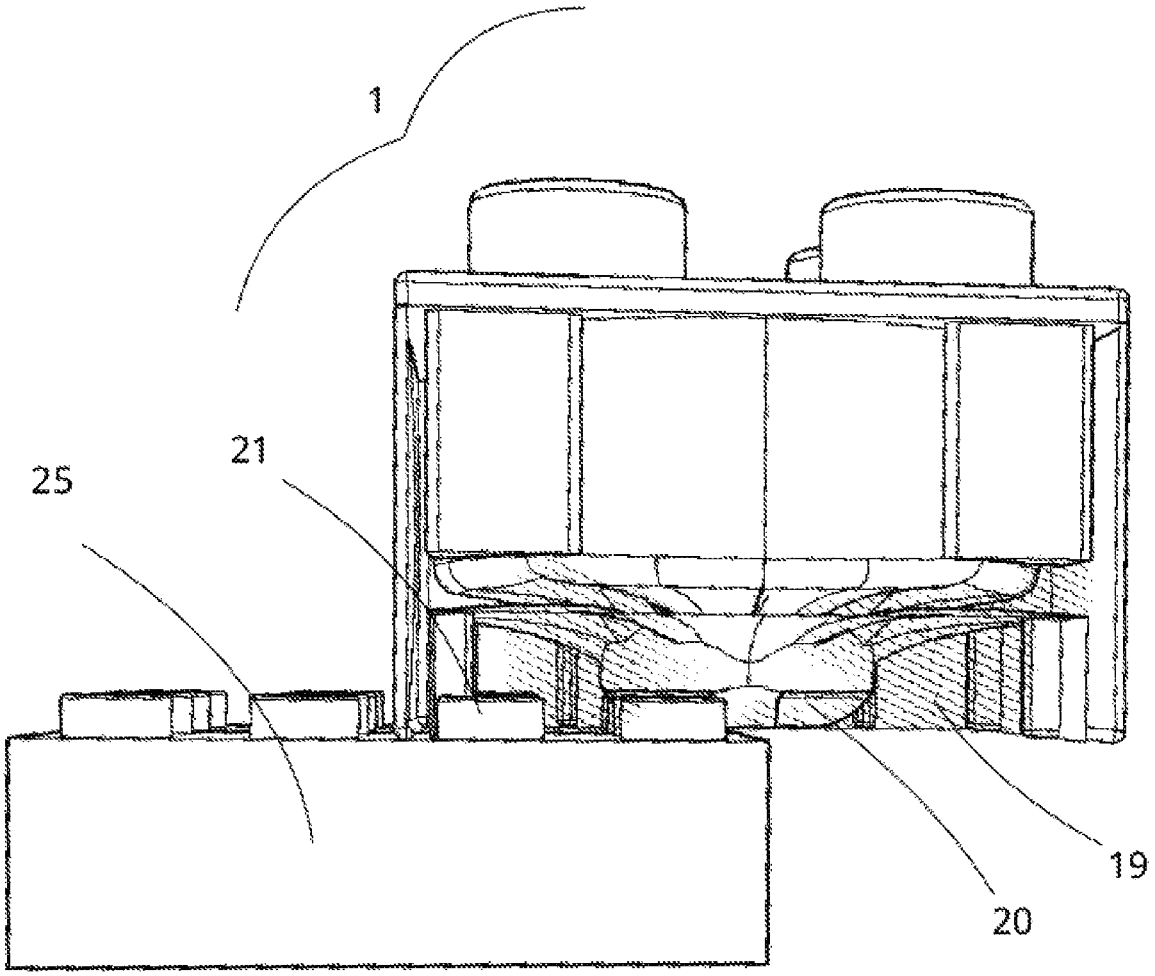
FIG. 12B shows the block of FIG. 12A with the "female" snapfit element engaging/holding the "male" snapfit element of small-style block (e.g. Lego®).
Figure 12C:
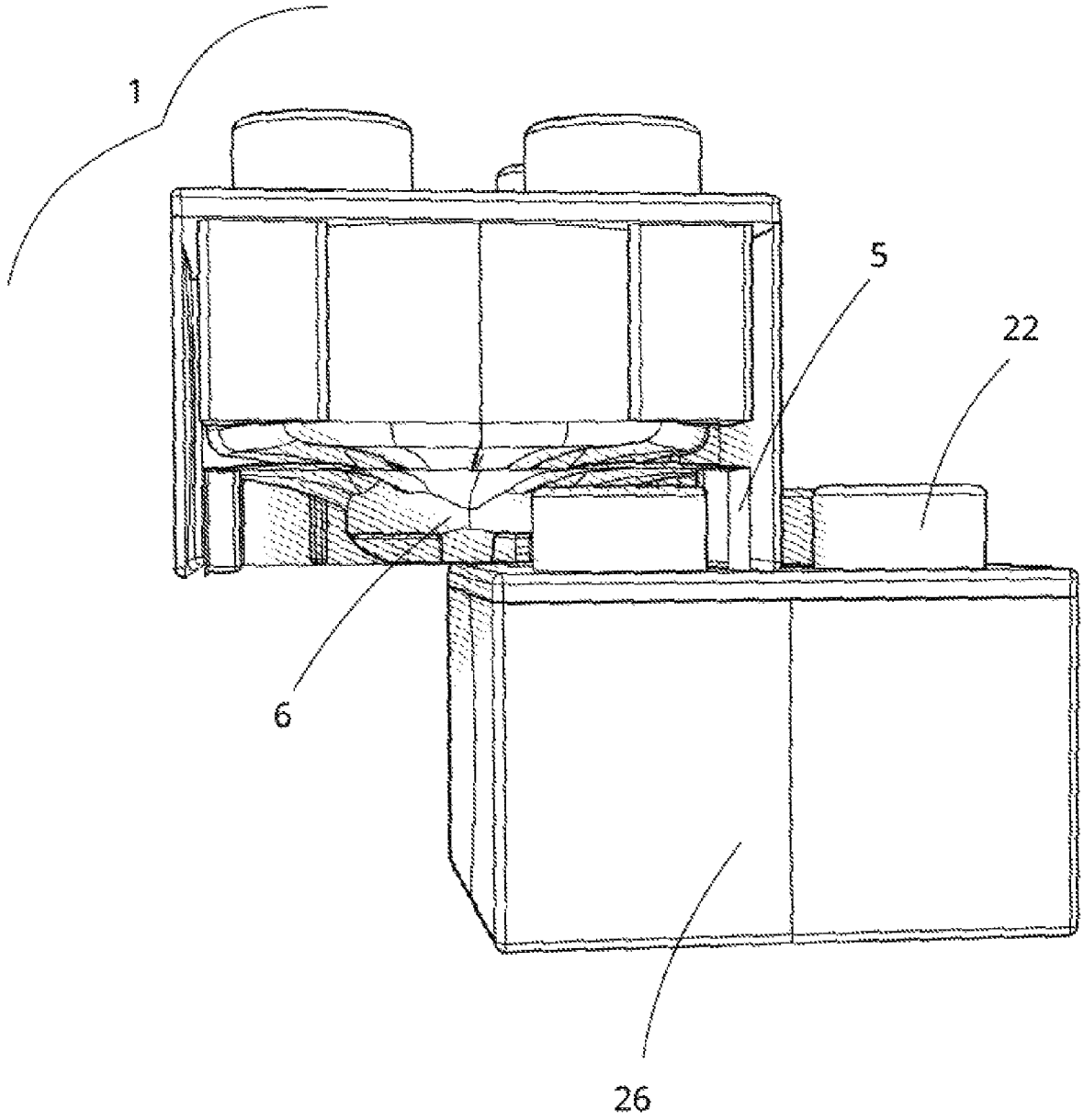
FIG. 12C shows the block of FIG. 12A with the "female" snapfit element engaging/holding the "male" snapfit elements of large-style block (e.g., Duplo®).
Figure 13:
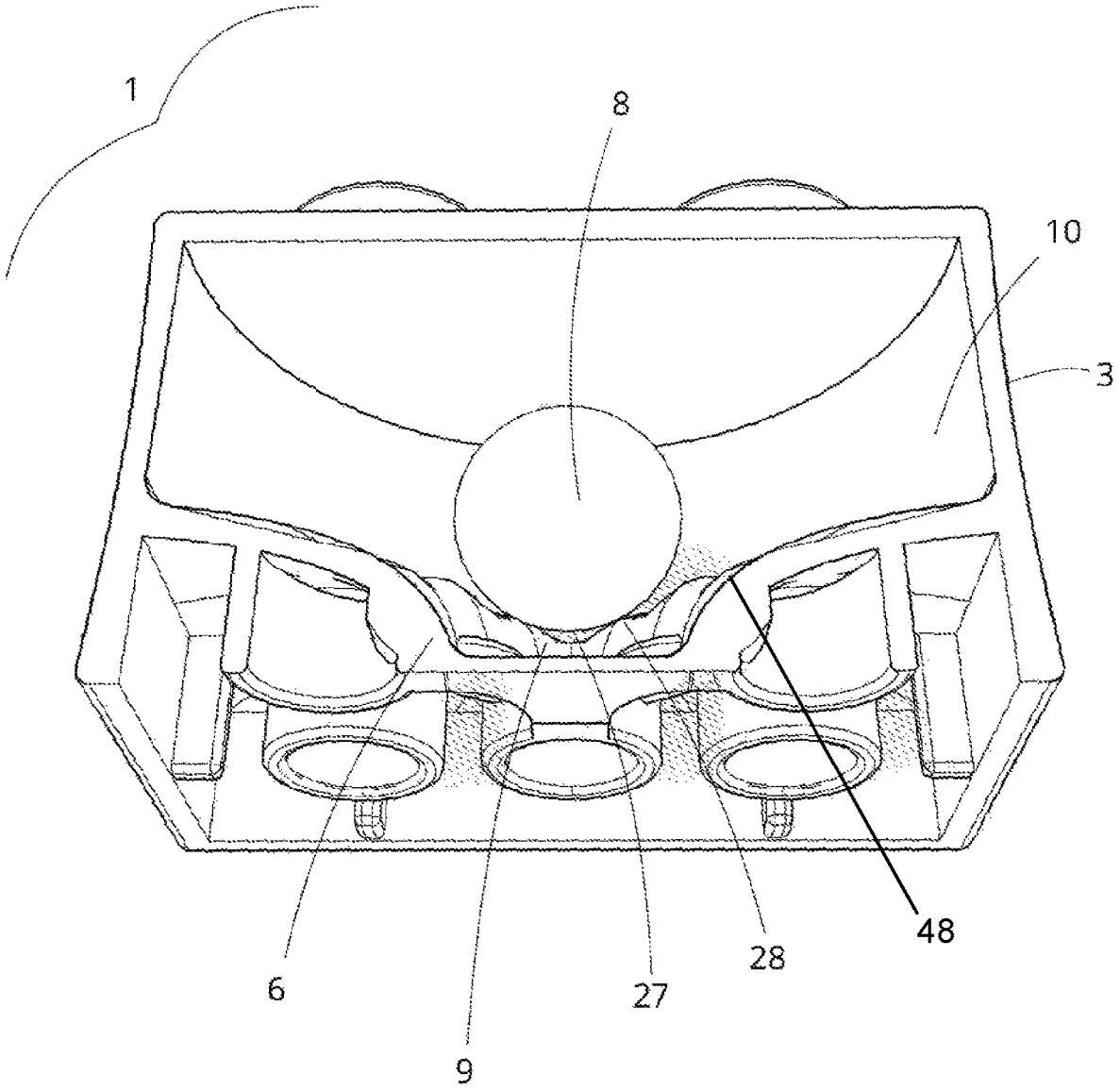
FIG. 13 is a partial cross-sectional view of the block of FIG. 12A.

As seen in FIGS. 2, 11B and 12B, when the "male" convex snapfit element of a small-style block (e.g., Lego®) is "snapped" into the underside (4) of the disclosed block (1), each male element is inserted into spaces formed on the underside (4) such that the inner sides (19) of the block's underside (4), the cutouts (20) at the end of the column or shaft (6), and a series of walled shafts (43), work in concert to engage and squeeze the male studs that comprise the male snapfit element, thereby holding the two blocks together. FIG. 11B shows the underside of the disclosed block (1). Dashed lines (21) serve to demonstrate the potential locations of the male studs of an attached, small-sized, non-magnetic, snapfit block (Lego®, etc.). The disclosed block (1) holds the non-magnetic snapfit block in place by squeezing its male studs (21). The squeezing is brought about by a combination of pressures exerted on the studs by the column cutouts (20), the walled shafts (43), and the walls (19). Thus, the spaces formed between the components (5), (6), (19), (20), (43) of the underside (4) comprise the "female"/concave snapfit connection element of the block (1). FIG. 12B shows the disclosed block (1) with one face removed in order to see a profile view of the block's (1) female snapfit element as it connects with the male snapfit element (21) of a non-magnetic, small-style block (25).

As shown in FIG. 2, the column or shaft (6) is of large enough diameter to engage and squeeze the "male" element of an attached large-style block, and to house the disclosed block's (1) internal stand-alone magnet (8) for magnetic connections through the block's (1) female snapfit connection element. Likewise, the cutouts (20) at the end of the column or shaft (6) should be of sufficient size and design to engage and squeeze the male/convex connection element of a small-style block without being so large as to prevent the stand-alone magnet (8) from residing within column or shaft (6). To facilitate a magnetic connection through the block's underside (4), the wall thickness at the end of column (6) should be sufficiently thin; determined primarily by the size of the internal stand-alone magnet (8), the level of magnetic pull-force desired, and manufacturing and product safety constraints. Should wall thickness minimums demand it, parts of column or shaft (6) and cutouts (2) may be cut away entirely, making the stand-alone magnet (8) partially viewable through the female connection element (unless some form of cover is used). Any holes exposing the internal stand-alone magnet (8) must be sufficiently small to prevent the stand-alone magnet (8) from exiting the cavity (11), as will be described in more detail below.

These snapfit connections hold the blocks together until such time when sufficient force is exerted to pull the blocks apart. In this manner, the female snapfit connection element of the disclosed block (1) is capable of attaching to both the male connection elements of small and large-style blocks.

The disclosed block (1) may be made of any number of materials, including, but not limited to, plastic, rubber, or any combination of materials. The preferred composition is a hard rubber or hard rubber-like substance offering the following benefits: (i) increased friction between the disclosed block (1) and a magnetically attractable surface. Increased friction aids the magnetic pull-force in keeping the disclosed block (1) and any attached structures from slipping or rotating undesirably about the magnetically attractable surface (14); and (ii) because rubber is softer and spongier than plastic, the sounds of the internal stand-alone magnet's (8) movements are less audible to a block user. While the disclosed block (1) and its internal stand-alone magnet (8) may be of any size, the preferred embodiment—for the purposes of pairing effectively (both mechanically and visually) with "large-style" Duplo® and "small-style" Lego® blocks—should be approximately 32 mm wide, 32 mm depth, and 19.2 mm tall (plus a stud (i.e., male snapfit connection element) height of 4.5 mm). The internal stand-alone magnet (8) in this preferred embodiment is a sphere approximately 5/16" in diameter.

Figure 5A:
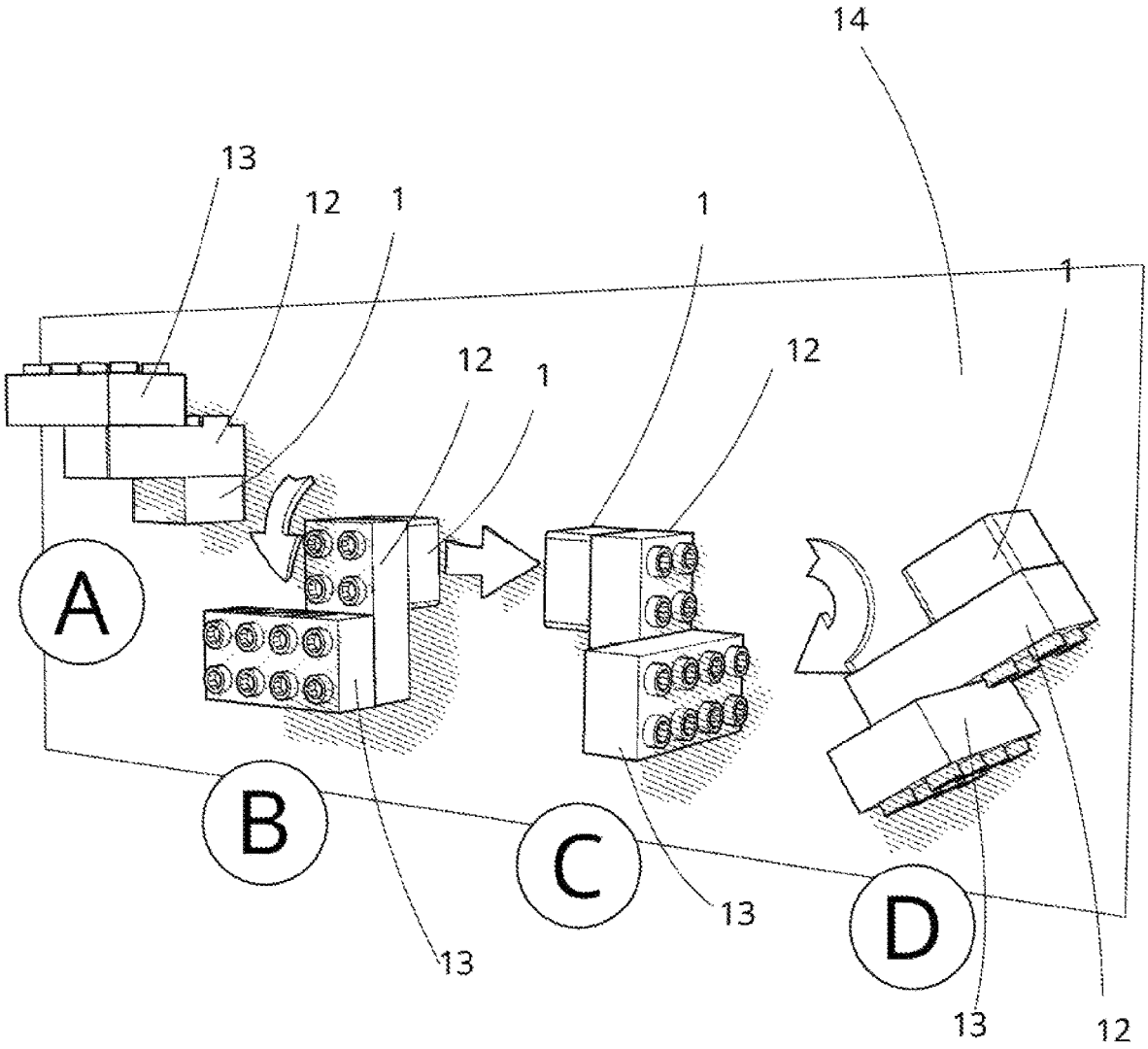
FIG. 5A shows the block of FIG. 1 (and attached non-magnetic blocks) attached to a magnetically attractable surface in a series of orientations.

FIGS. 5A-5C and 7 illustrate the disclosed block (1) in operation. In one example, FIG. 5A shows the disclosed block (1) supporting non-magnetic blocks (12), (13) on a magnetically attractable surface (14) in series of time-lapse images (A→D, with A being the earliest image in the series). Arrows depict the direction of rotation undergone by the disclosed block (1) and attached blocks (12), (13) in each image. In image A, the disclosed block (1) has been attached magnetically via one of its sides (3) to the magnetically attractable surface (14). Non-magnetic block (12) has been attached via its "female" connection element to the "male" connection element on the top side of the disclosed block (1). Likewise, non-magnetic block (13) has been attached via its "female" connection element to the "male" connection element on the top side of non-magnetic block (12). Successive images show the disclosed block (1) and attached non-magnetic blocks (12 & 13) being rotated in unison—first 90 degrees downward (B), then 90 degrees to the right (C), then spun or rotated an unspecified number of degrees clockwise with respect to the surface (14) (D).

In another example, FIG. 5B shows an alternative, preferred embodiment of the disclosed block (31) (described in more detail below) attached to non-magnetic block (12). Both blocks are adhered to a magnetically attractable surface (14) by way of the magnetic pull from the disclosed block (31), despite the fact that neither block (31), (12) is making planar contact the magnetically attractable surface (14) (i.e., both blocks (31), (12) make contact with the magnetically attractable surface (14) along their edges rather than on one of their faces).

Figure 5C:
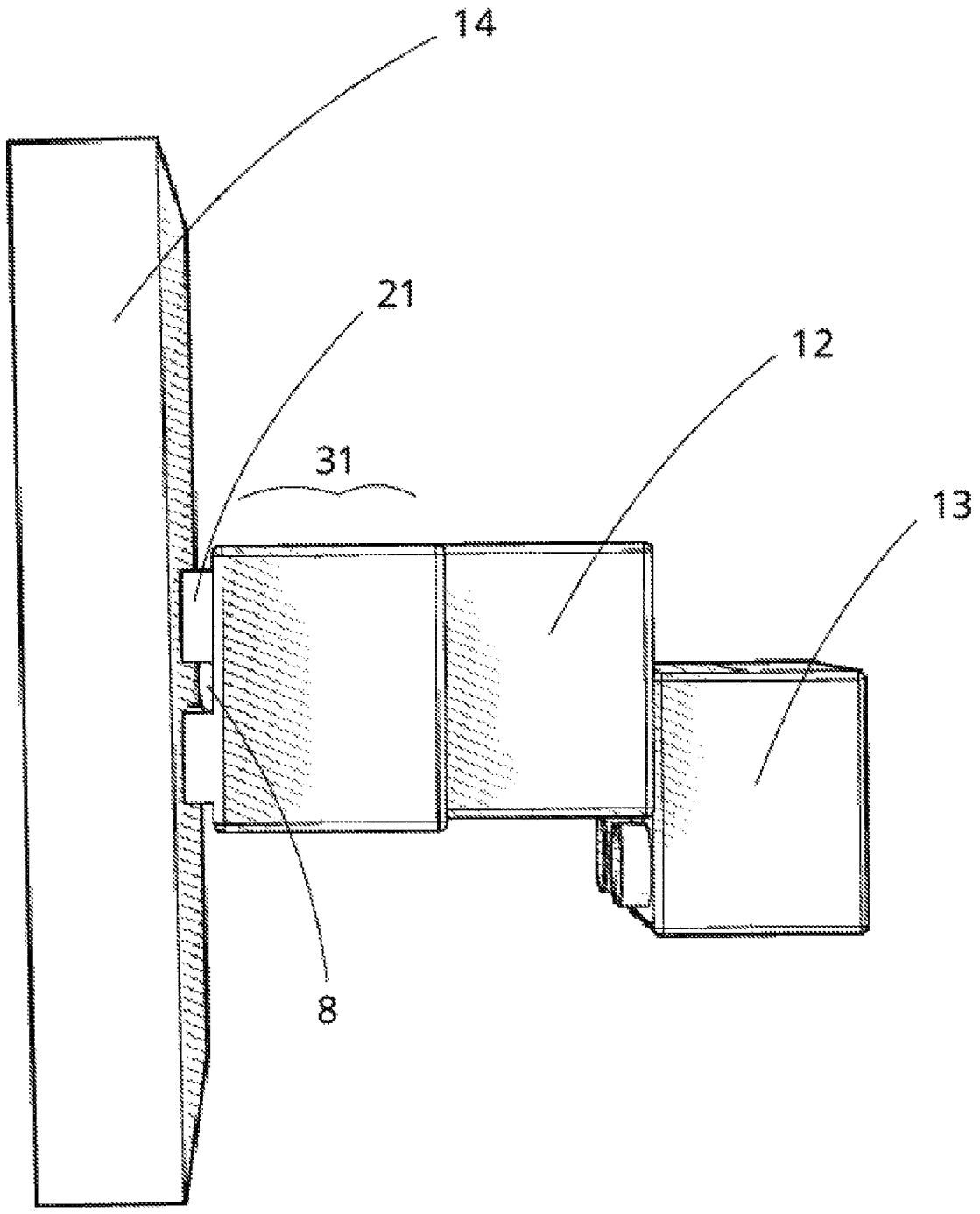
FIG. 5C shows the block of FIG. 5B (with attached non-magnetic blocks) adhered to a magnetically attractable surface via a face containing a "male" snapfit element.

In yet another example, FIG. 5C shows the disclosed block (31) adhered to a magnetically attractable surface (14) via a face containing studs comprising a "male" snapfit connection element (21). The internal stand-alone magnet (8) protrudes through a magnet protrusion hole (29), shown in FIG. 5B, located in the middle of the male connection element (21). The hole (29) is large enough to allow the stand-alone magnet (8) to protrude through the hole (29) to close proximity with the magnetically attractable surface (14) sufficient to adhere the block (31) to the surface (14). The hole (29) is sufficiently small enough to prevent the stand-alone magnet (8) from fully exiting the block (31).

Figure 7:
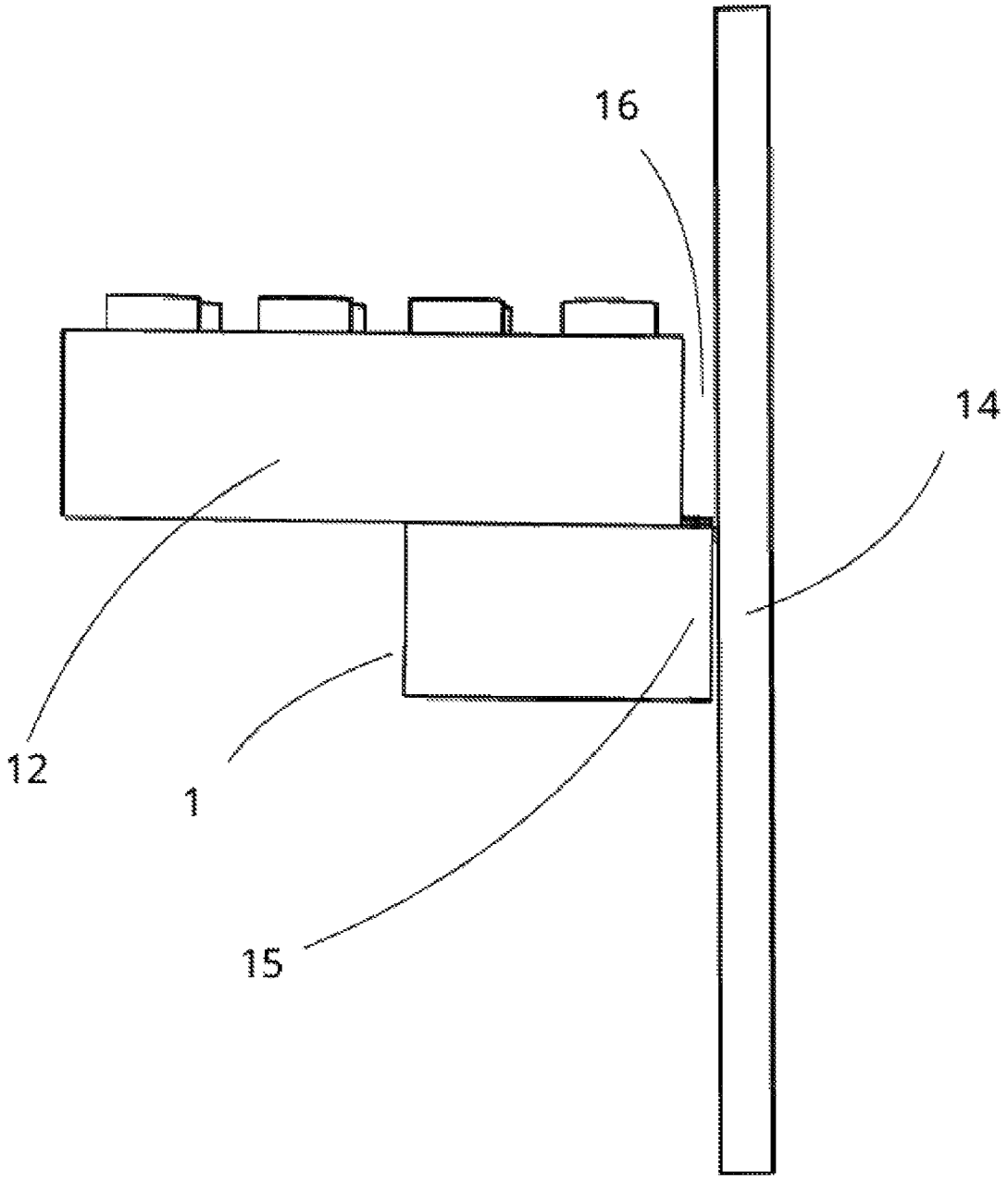
FIG. 7 shows a side view of an alternative embodiment of a block of the present invention attached via its "male" connection element to a non-magnetic snapfit block.

In another example of the operation of the block (1), FIG. 7 shows an alternative embodiment of the disclosed block (1) adhered to a magnetically attractable surface (14) from a side view. Attached to the block's (1) "male" connection element is a non-magnetic block (12). In this alternative embodiment, the disclosed block (1) features a longer, more rectangular shape (15) than other embodiments. While other embodiments may match the width and depth of common snapfit blocks, the rectangular shape of this embodiment serves to put a gap (16) between the non-magnetic block (12) and the magnetically attractable surface (14). This gap (16) eliminates any friction between the non-magnetic block (12) and the magnetically attractable surface (14) which may be beneficial in certain instances.

Figure 21A:
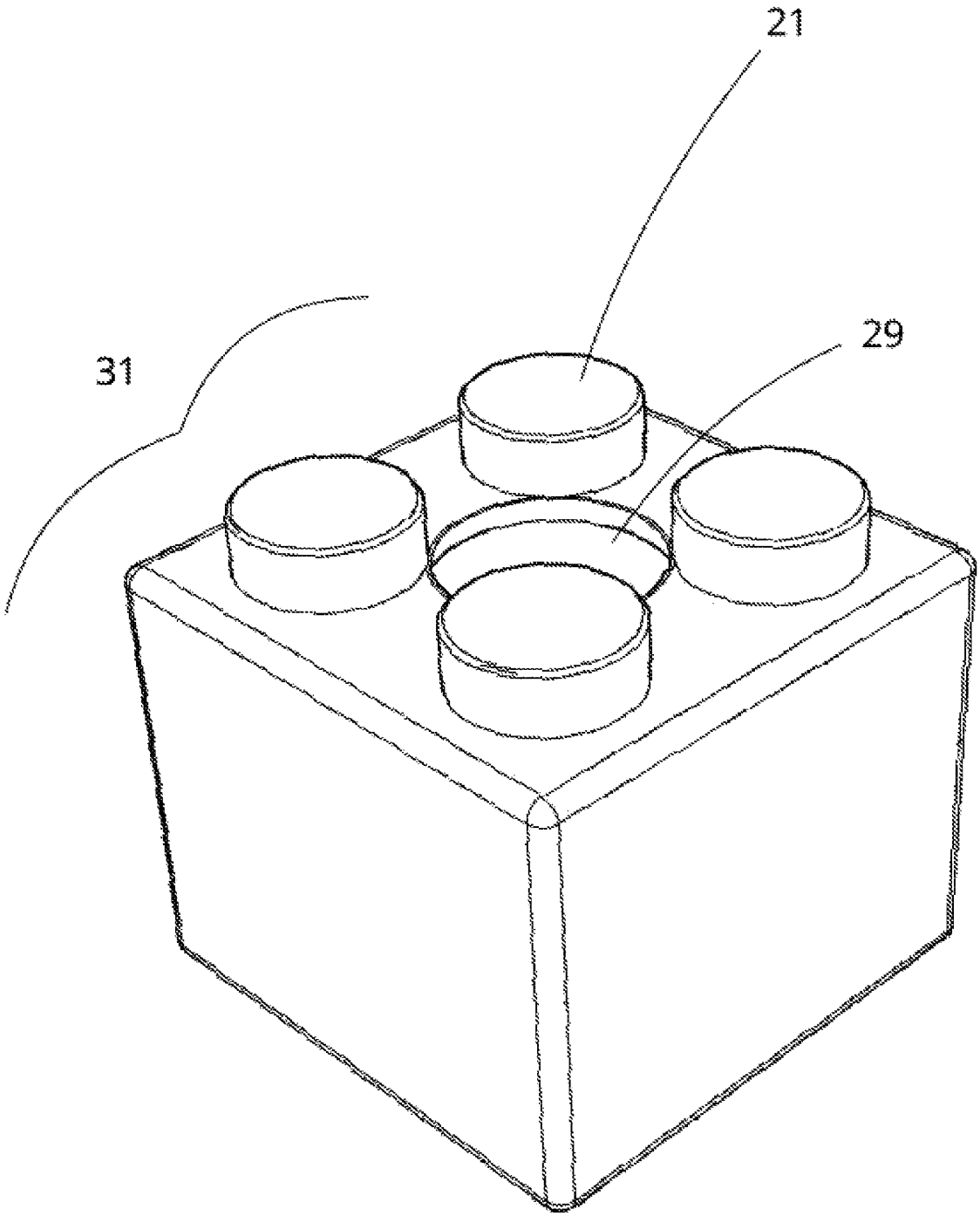
FIG. 21A shows a top perspective view of a preferred embodiment of the block of the present invention featuring a 2×2 pattern of "small-style" (e.g., Lego®) studs as its "male" connection element.
Figure 21B:
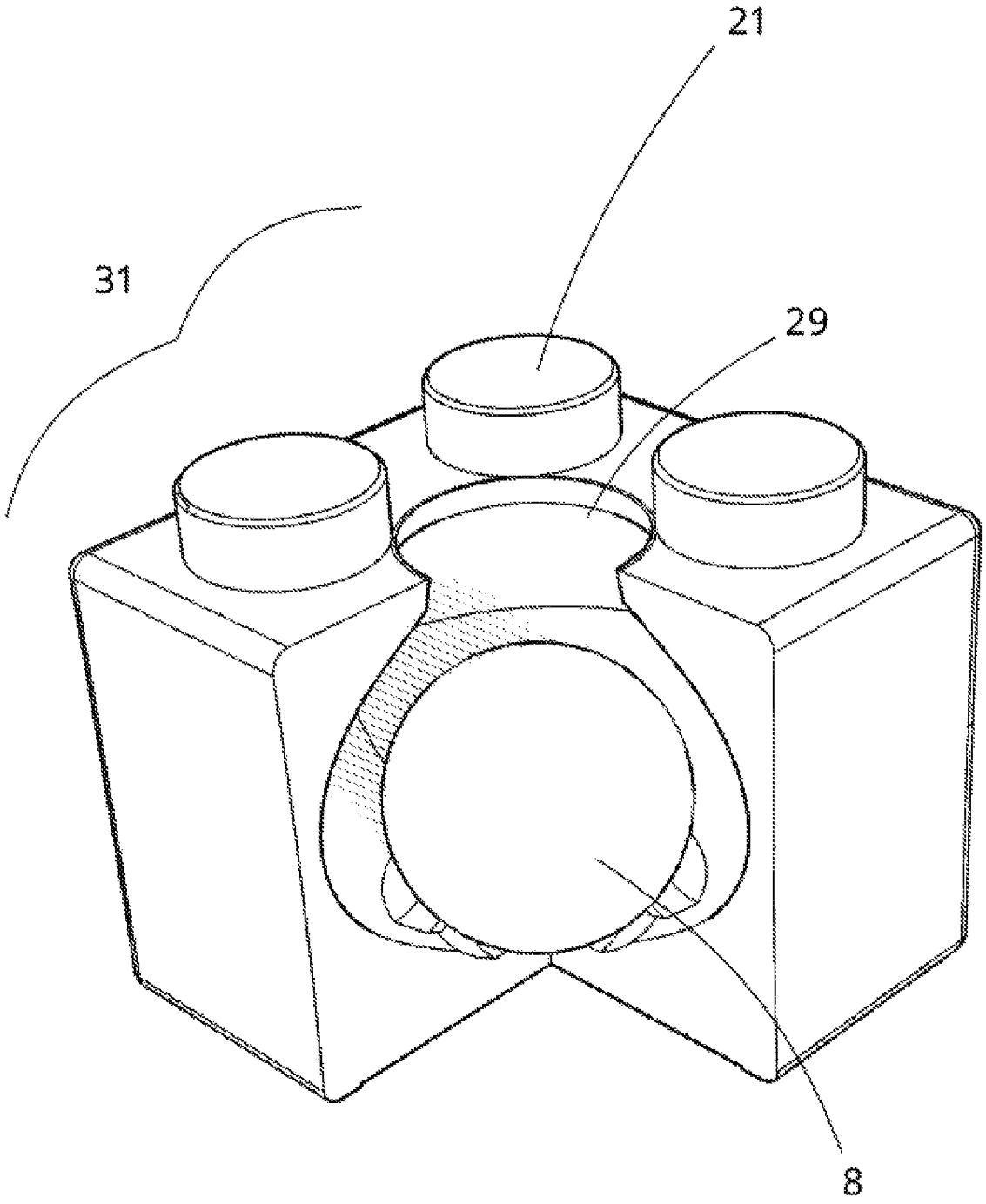
FIG. 21B shows a partial cross-sectional view of the disclosed block of FIG. 21A.
Figure 21C:
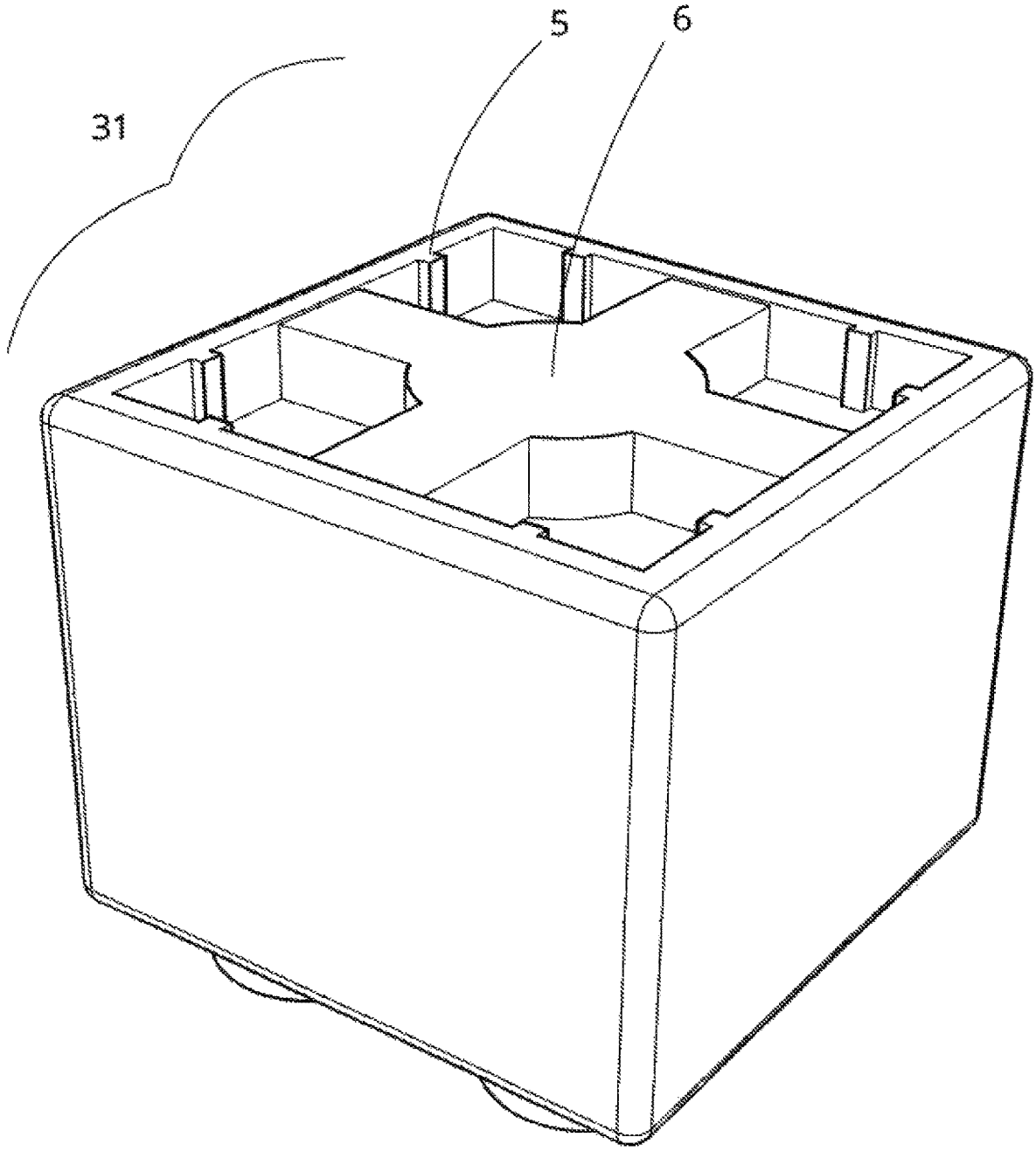
FIG. 21C shows a bottom perspective view of the disclosed block as embodied in FIG. 21A.

FIGS. 21A-21C shows a preferred embodiment of the disclosed block (31) of the present invention. In the preferred embodiment, the block (31) contains one side with a 2×2 pattern, male snapfit connection element designed to be compatible with a small-style, female snapfit connection element. The male snapfit connection element contains a magnet protrusion hole (29) near its center. The hole (29) in this embodiment is substantially circular but could take on other shapes as well, depending on the shape and size of the stand-alone magnet (8). As with the other embodiments, this female snapfit element connects with the male element of common small-style snapfit blocks by squeezing the protruding studs of the other block, as described above. As described above, the squeezing force is provided by the outside of the central column or shaft (6) in conjunction with the wall protrusions (5). While the disclosed block (31) may assume many sizes, the preferred embodiment is approximately 14.6 mm in height (12.8 mm in main body height plus 1.8 mm for the studs), 16 mm in width, and 16 mm in depth. The preferred embodiment of the disclosed block (31) shares the width and depth of common, 2×2 patterned snapfit blocks (Lego®, etc.) to ensure its compatibility with common snapfit blocks (i.e., no side protrudes in a manner such as to complicate building with a combination of disclosed blocks and common snapfit blocks). The preferred embodiment of the disclosed block (31) is taller than common snapfit blocks to ensure that the internal cavity is sufficiently tall enough to allow for the free movement of the contained stand-alone magnet (8). The amount of added height is not chosen arbitrarily, however; rather, the height (14.6 mm) is approximately equal to that of a common brick (9.6 mm)+a common plate (3.2 mm)+common stud height (1.8 mm). As with the width and depth, this particular height ensures that the disclosed block (31) will work well in structures comprised of a combination of disclosed blocks (31), and common, small-style snapfit blocks. Note that three common plates positioned one on top of the other generally add up to the height of one common brick. However, the dimensions could be modified to conform with "large-style" Duplo® blocks as well.

Figure 22A:
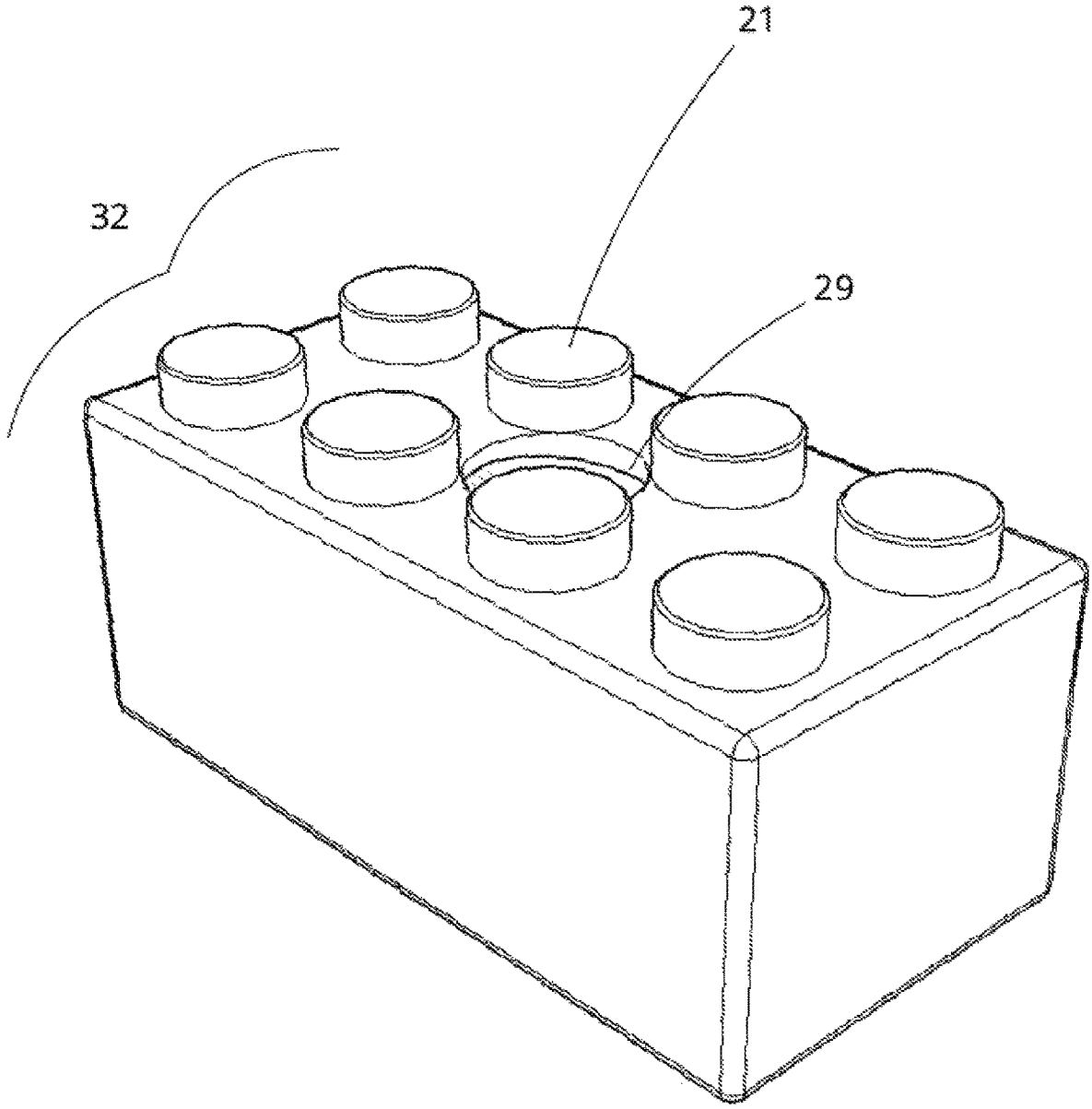
FIG. 22A shows a top perspective view of an embodiment of the disclosed block of the present invention featuring a 2×4 pattern of "small-style" (e.g., Lego®) studs as its male connection element.
Figure 22B:
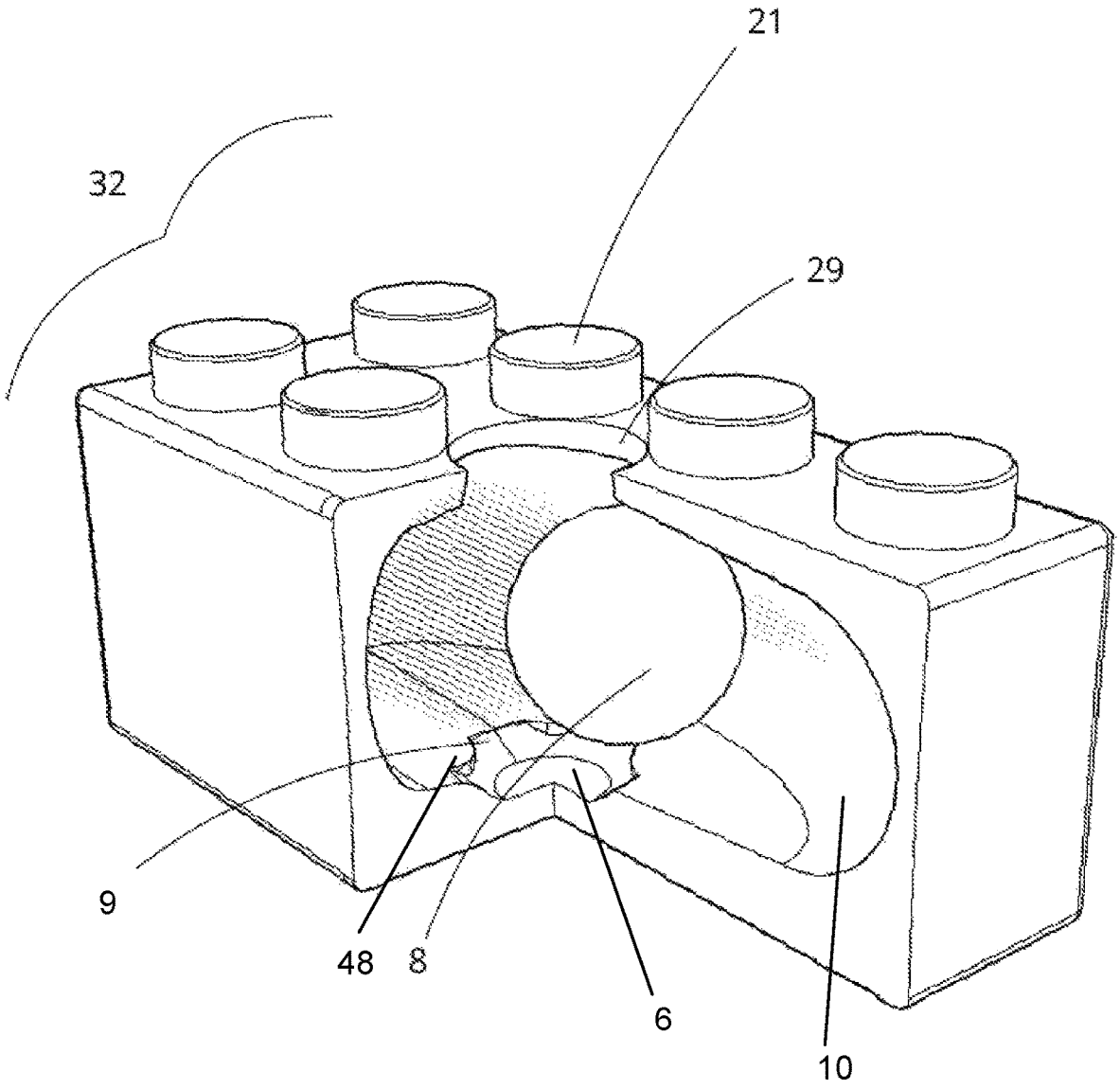
FIG. 22B shows a partial cross-sectional view of the disclosed block as embodied in 22A with the corner portion removed in order to demonstrate the block's interior.
Figure 22C:
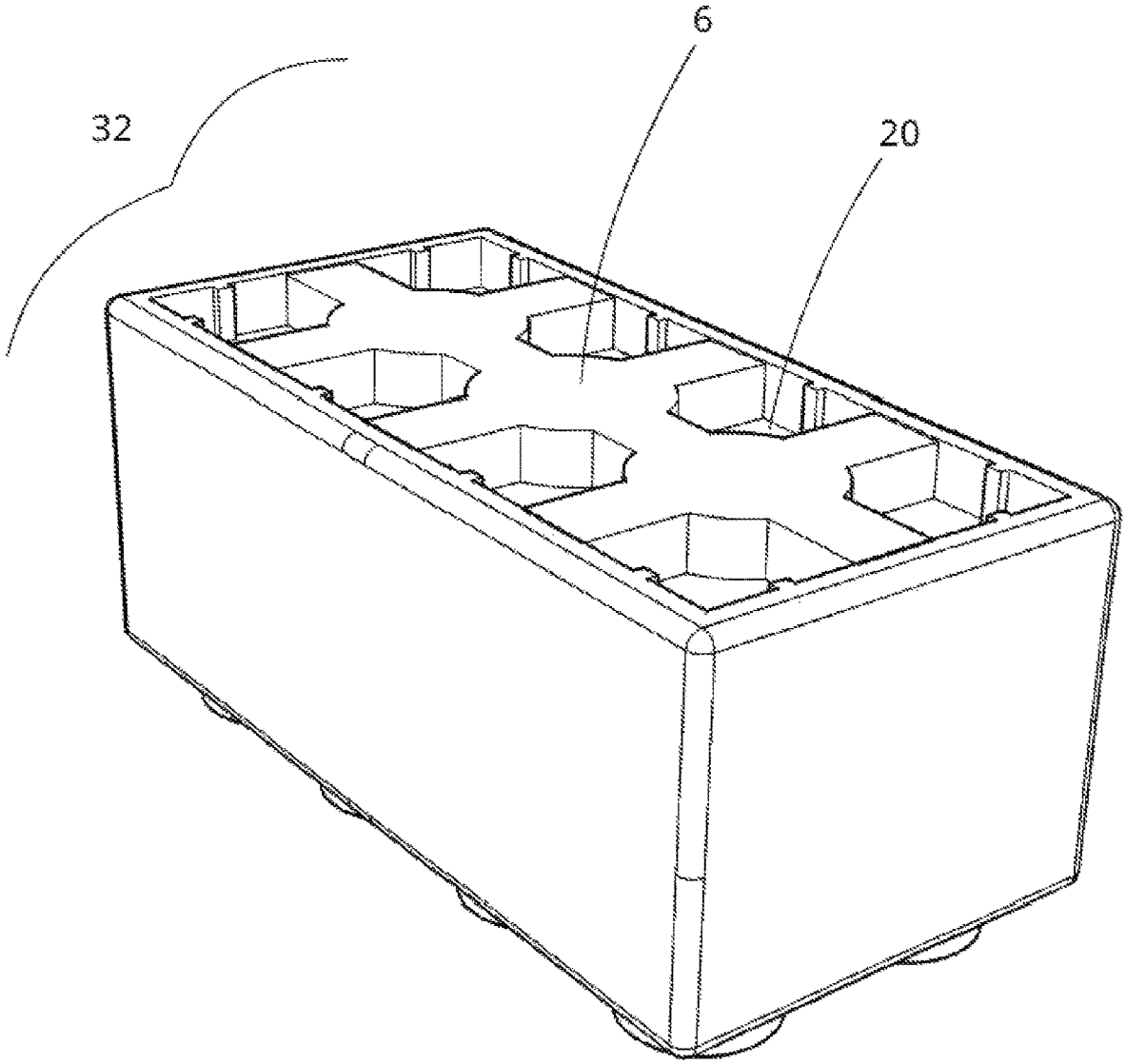
FIG. 22C shows a bottom perspective view of the disclosed block as embodied in 22A.

Referring to FIGS. 22A-22C, the block of the preferred embodiment (31) could be manufactured in various sizes. For example, the referenced figures show an embodiment of the disclosed block (32) featuring a 2×4, small-style stud pattern for its male snapfit connection element. The block's height and depth remain the same as the block embodied in FIG. 21A. The width, however, has been doubled, matching the width of common, small-style 2×4 stud blocks. As shown in FIG. 22B, the column (6) is formed below the cavity walls (10) and below the alternating indents (48) and channels (9).

Figure 24A:
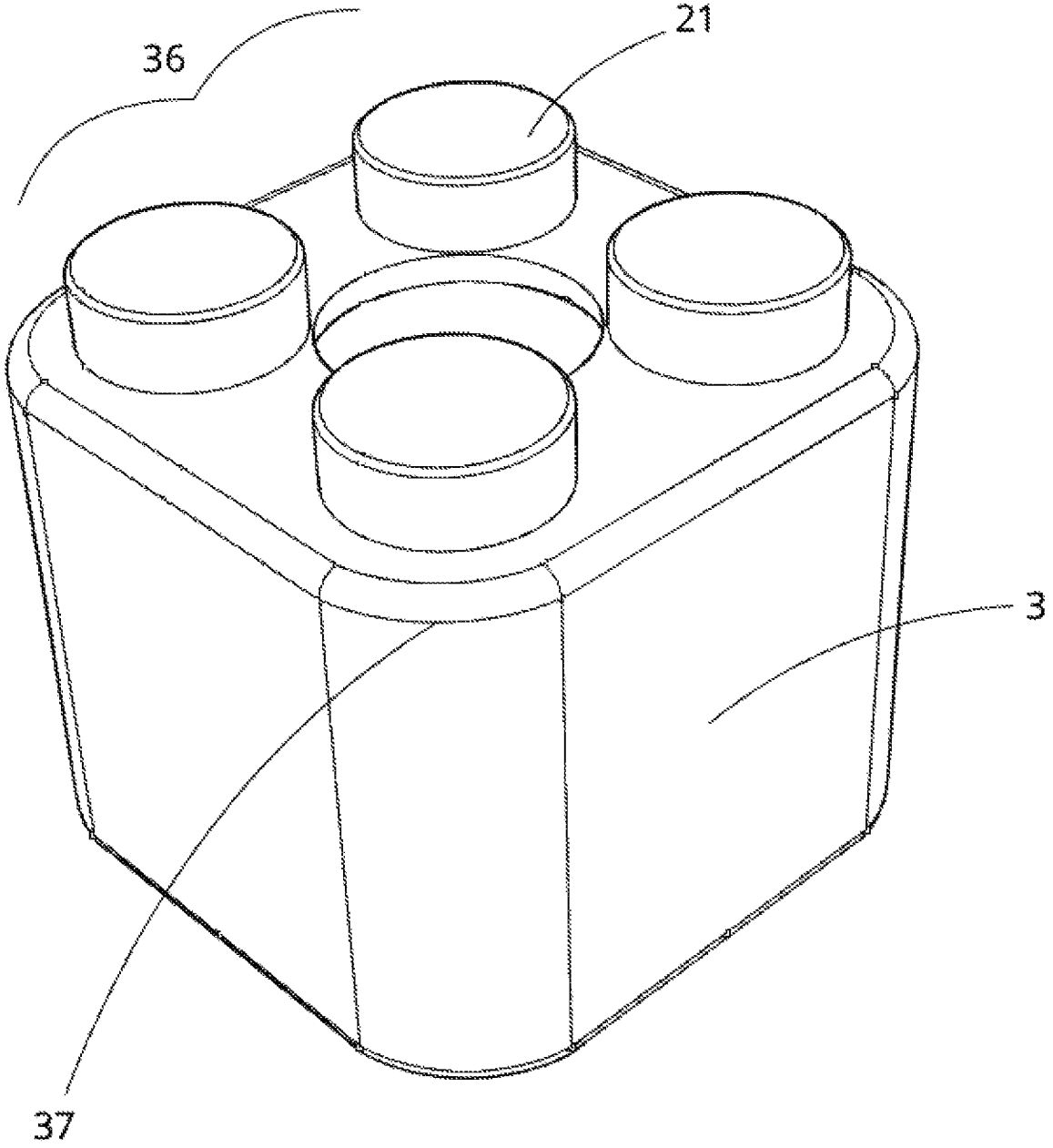
FIG. 24A shows a top perspective view of an alternative embodiment of the disclosed block of the present invention featuring rounded edges.
Figure 24B:
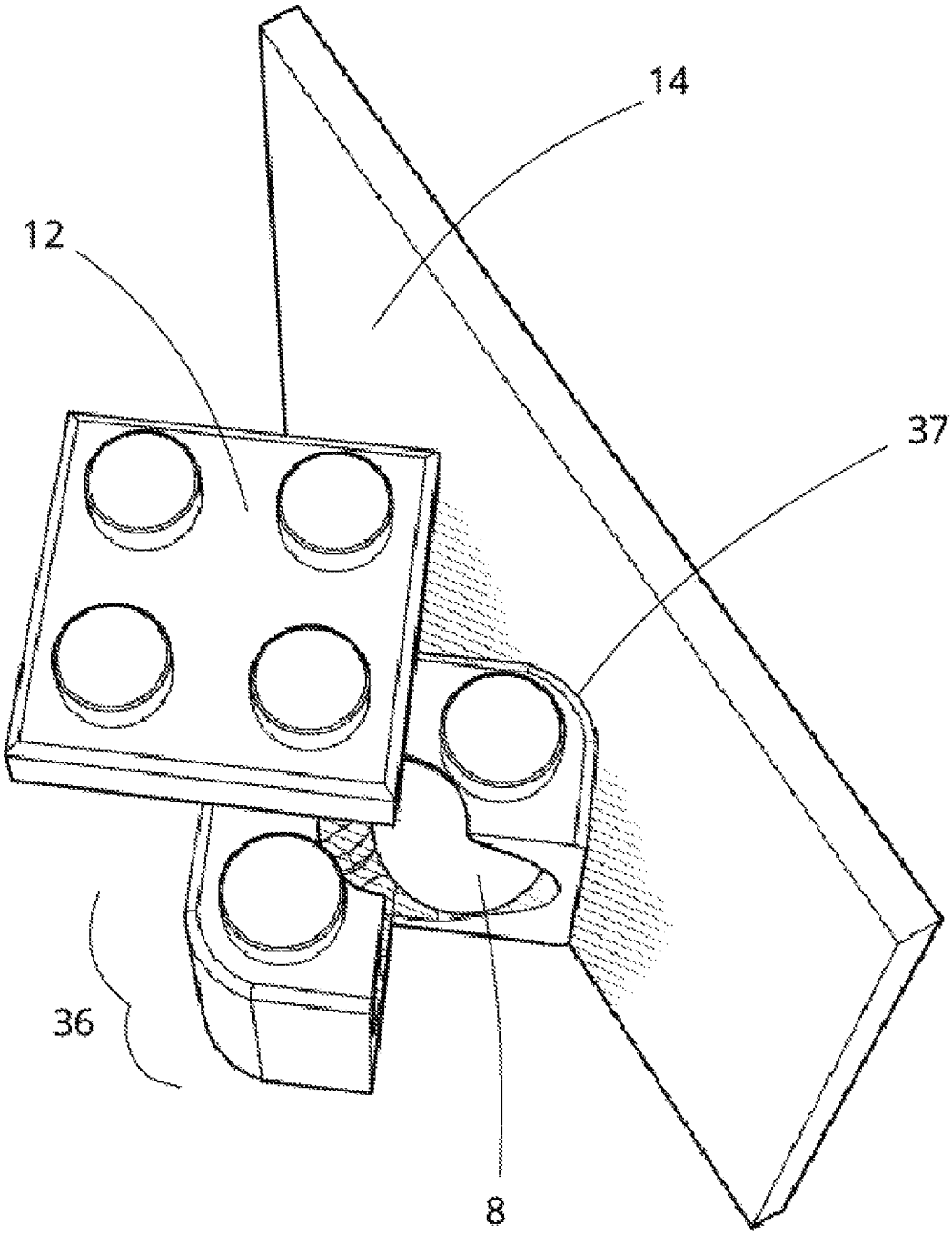
FIG. 24B shows a partial cross-sectional view of the disclosed block of FIG. 24A connected with a non-magnetic block and attached to a magnetically attractable surface via one of the disclosed block's rounded edges.
Figure 24C:
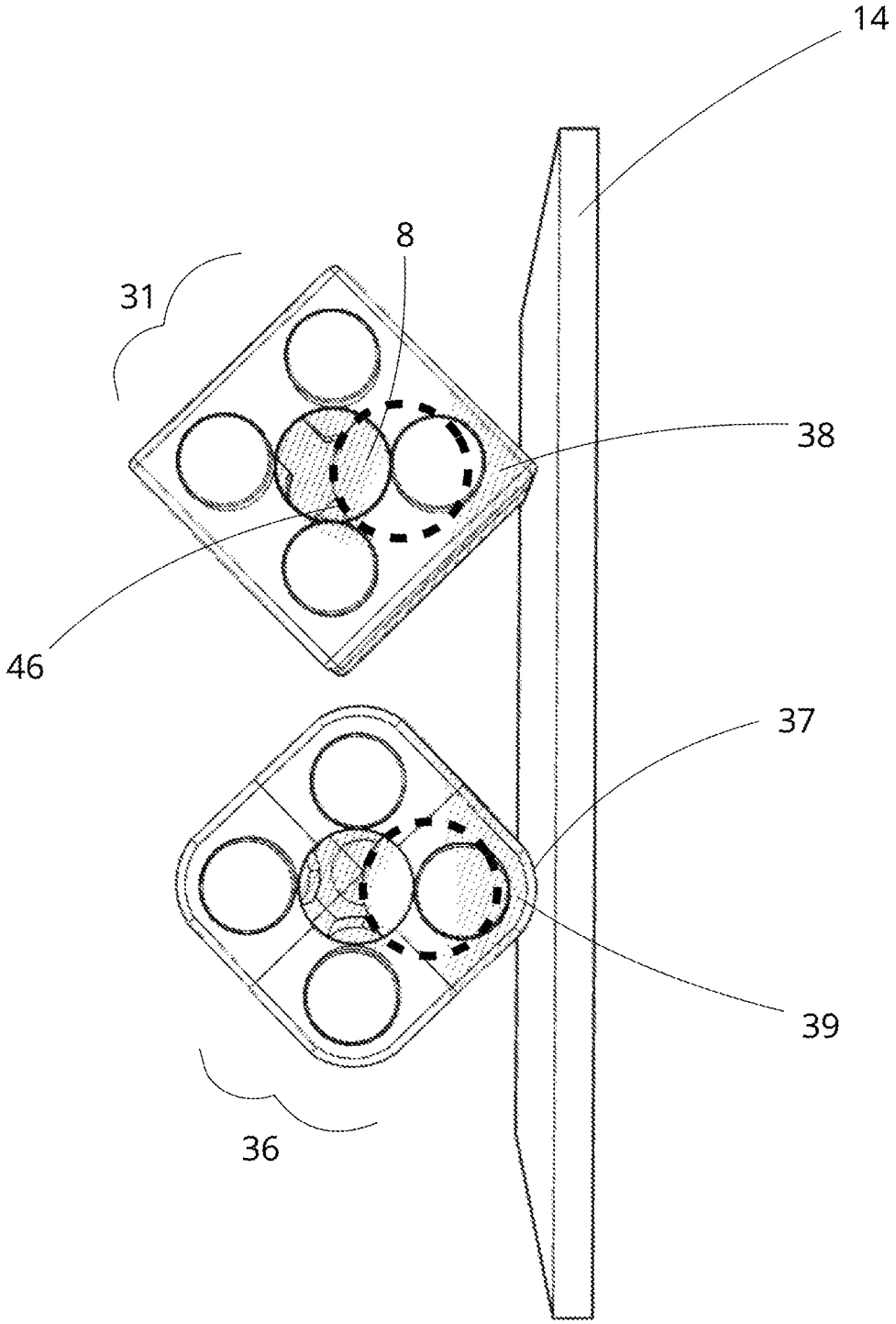
FIG. 24C shows plan views of two iterations of the disclosed block of the present invention—one with rounded edges, one without—attached to a magnetic surface.

Referring to FIGS. 24A-24C, the block of the preferred embodiment (31) could also be modified with rounded edges (37) joining the block sides (3), as shown in the referenced figures. Such rounding allows the internal stand-alone magnet (8) to achieve a closer proximity to a magnetically attractable surface (14) when the disclosed block (36) is placed on one of its rounded edges (37) on said surface (14). The radius of the rounding should not be so large as to infringe upon the block's (36) ability to connect via its snapfit connections (male or female) to other blocks. As shown in FIG. 24B, the disclosed block (36) is connected to a non-magnetic snapfit block (12) via a portion of its male snapfit connection element. The connected blocks are then adhered to a magnetically attractable surface (14) via the disclosed block's magnetic pull force through one of its edges (37). As a result of the block's edge (37) being rounded, the block's (36) internal stand-alone magnet (8) is able to achieve a closer proximity to the magnetically attractable surface (14), as seen in FIG. 24C. The strength of a magnetic pull force between two objects is directly related to their distance apart. Here, the pull force between the disclosed block (36) and the magnetically attractable surface (14) is stronger on account of the block's rounded edges (37), which allow the block's internal stand-alone magnet (8) to reside closer to the magnetically attractable surface (14). In FIG. 24C, the disclosed block (36) with rounded edges (37) is compared to another embodiment of the disclosed block (31) with edges that are either right angles or significantly less rounded than those on disclosed block (36). The stand-alone magnet's (8) location is shown on both blocks with broken lines (46). As a result of the rounded edges (37), the distance (39) between the magnet in disclosed block (36) and the magnetically attractable surface (14) is reduced, creating a stronger magnetic connection. Conversely, as a result of having right-angled edges, disclosed block's (31) internal stand-alone magnet (8) is at a greater distance (38) from the magnetically attractable surface (14), resulting in a weaker magnetic connection.

Figure 25A:
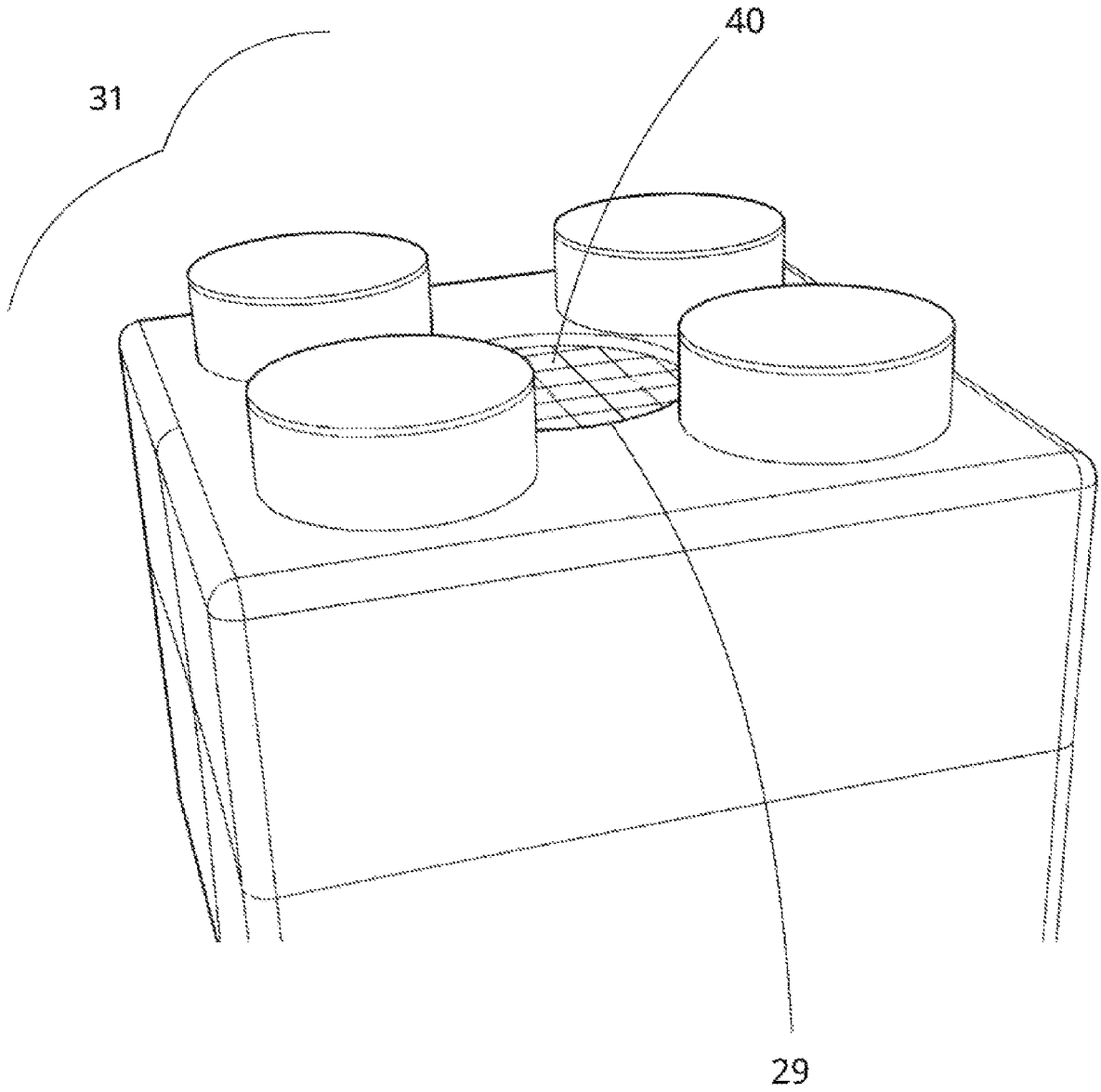
FIG. 25A shows a side perspective view of an embodiment of the disclosed block of the present invention featuring the magnet protrusion hole cover.
Figure 25B:
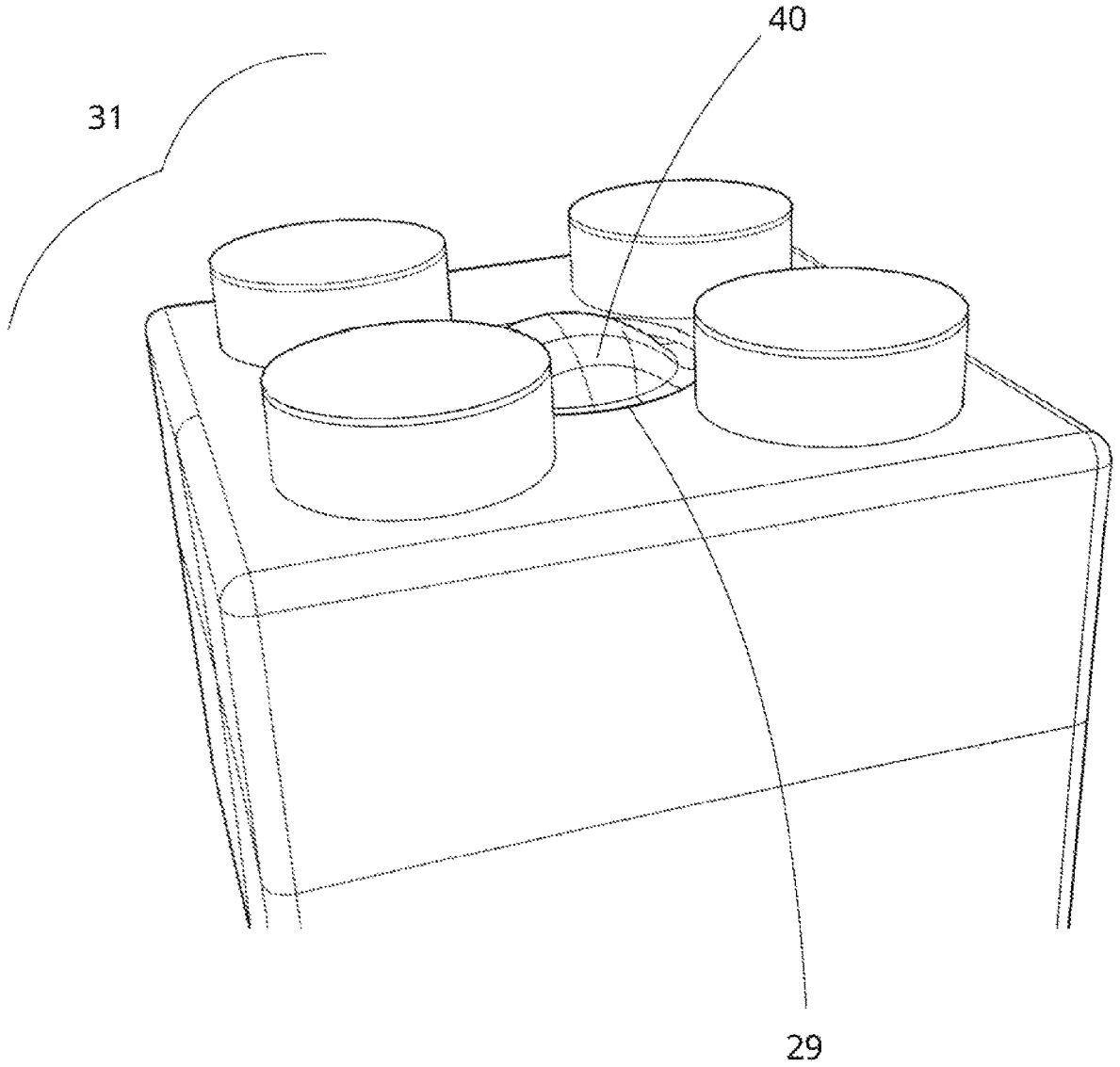
FIG. 25B shows a side perspective view of the disclosed block as embodied in FIG. 25A, with the internal magnet pressing against the hole cover, causing it to bulge outward from the block.

Referring to FIGS. 25A and 25B, in an alternative embodiment, the disclosed block (31) includes a cover (40) over its magnet protrusion hole (29). The cover (40) should be made of a flexible material (e.g., fabric, rubber, etc.) that is capable of bowing outwards from the block (31) when impressed upon by the block's internal stand-alone magnet (8). When the stand-alone magnet (8) is elsewhere in the block's cavity (11) (i.e., not protruding from the magnet protrusion hole (29)), the cover should return to its original, flattened form (as pictured) so that other blocks may attach to the disclosed block's (31) male snapfit connection element (21) unimpeded. However, the cover (40) could also be substantially rigid without departing from the spirit and scope of the present invention. The cover (40) serves the purpose of making the block's internal stand-alone magnet (8) invisible from outside of the block, as well as to prevent debris, et al. from entering the cavity (11) The cover should not negatively impact the block's ability to adhere to a magnetically attractable surface (14) via the side with a magnet protrusion hole (29). As shown in FIG. 25B, when engaged, the magnet protrusion hole cover (40) is bowed outwards, indicating that the internal stand-alone magnet (8) is currently protruding from the magnet protrusion hole (29). The cover (40) is provided to prevent debris from entering into the cavity (11). Also, the cover (40) serves to make the stand-alone magnet (8) invisible to block users in order to deter them from attempting to remove the stand-alone magnet (8).

Figure 27A:
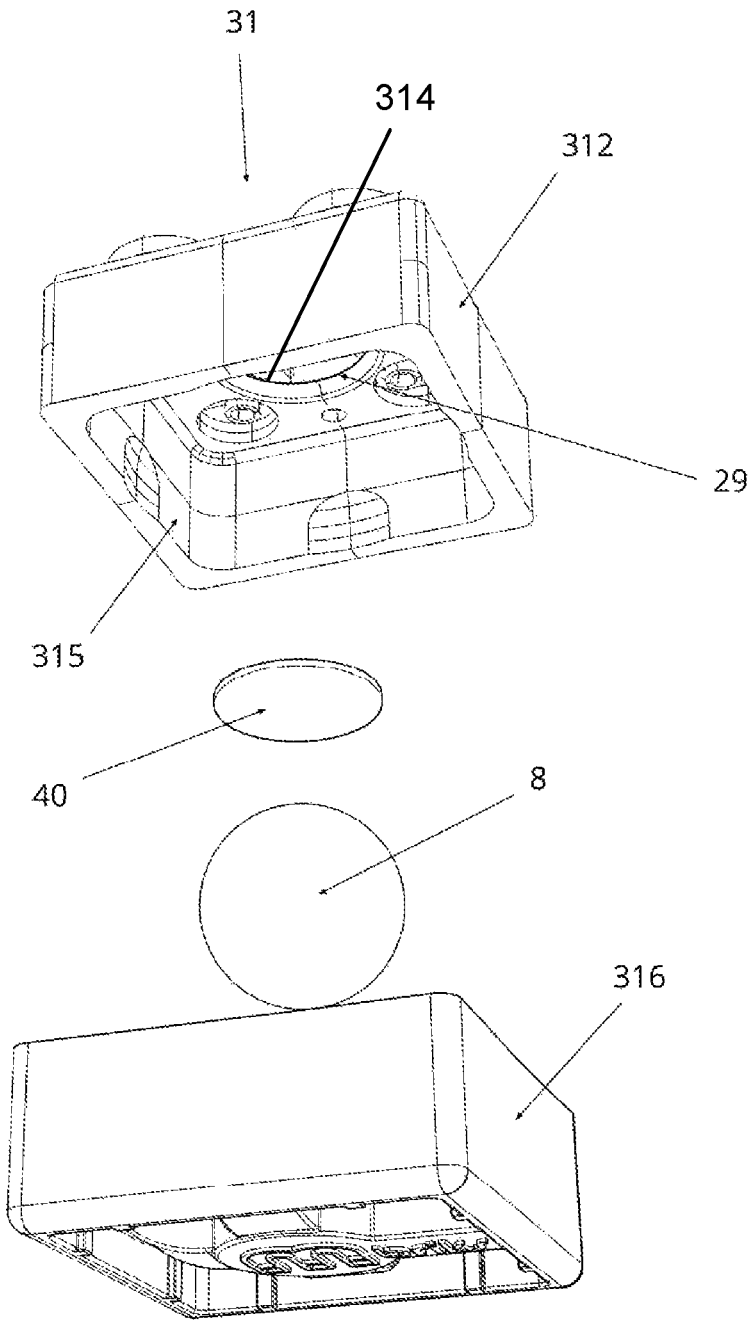
FIG. 27A is an exploded view of an embodiment of components of the blocks shown in FIGS. 25A-26.
Figure 27B:
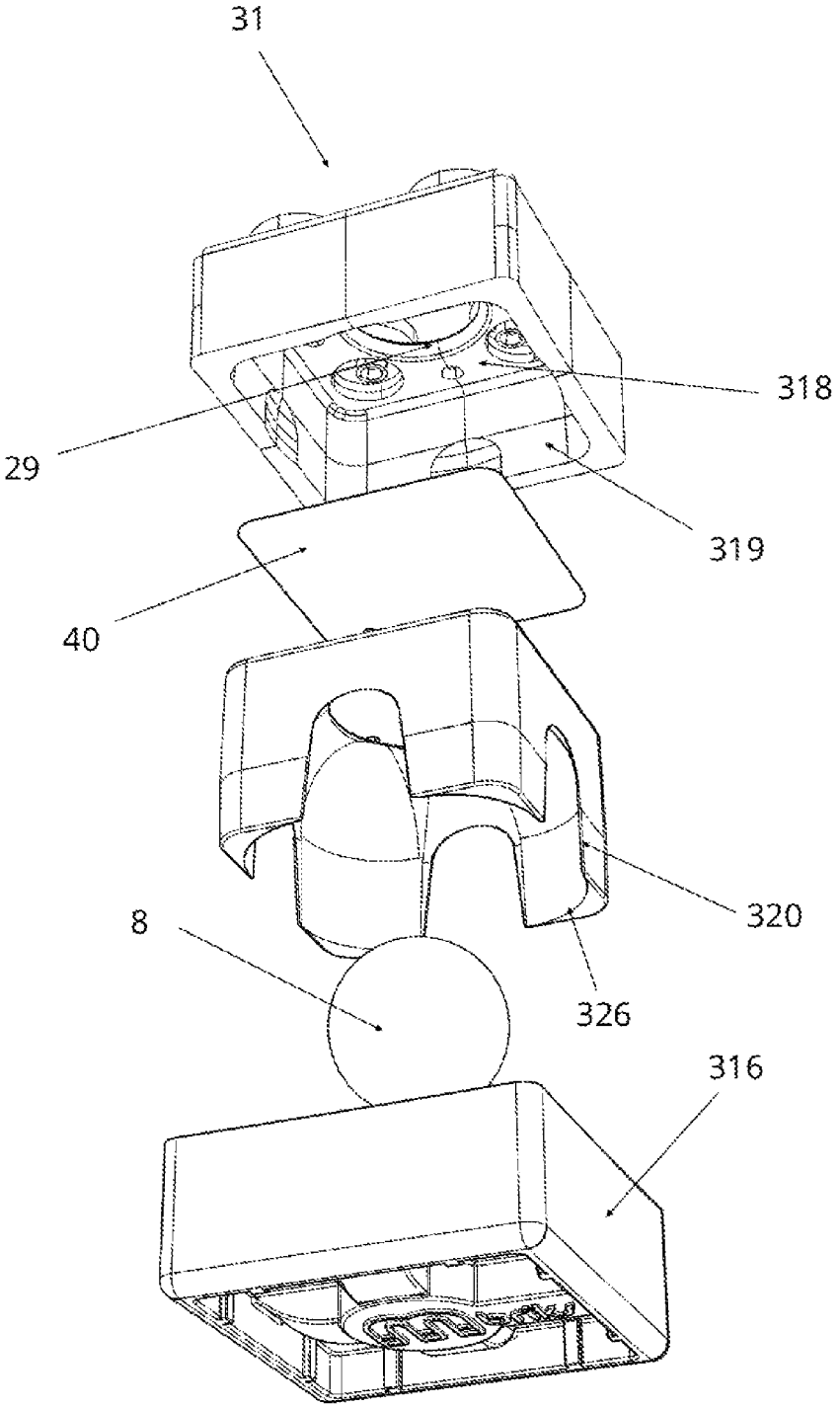
FIG. 27B is an exploded view of an alternative embodiment of components of the block shown in FIGS. 25A-26.

Referring to FIGS. 27A and 27B, the cover (40) could be installed to the block (31) in two different ways. In a first configuration, an underside of a top section (312) of the block (31) is provided with a groove or indent (314) formed around the protrusion hole (29) while having concave inner walls (315). The cover (40) is sized substantially similar to the groove (314) for a secure and snug form fit or friction fit. The top section (312) and a bottom section (316) are integrally formed together to provide the cavity (11) for the stand-alone magnet (8) to be positioned therewithin. In a second configuration, an underside (318) of the top section (312) is substantially flat and inner walls (319) are formed at right angles from the underside (318). The cover (40) is sized to match the underside of the top section (312) or is slightly smaller than the same. An intermediate member (320) is positioned between the top section (312) and the bottom section (316). The intermediate member (320) includes a substantially flat upper portion (not shown) and substantially flat outer side portions (322) that match the shape and size of the underside (318) and inner walls (319), respectively. An inner surface (324) of the intermediate member (320) is concave. The cover (40) is engaged with the top section underside (318) and a bottom end (326) of the intermediate member (320) engages an inner portion of the bottom section (316), thus securing the cover (40) to the top section (312). The top section (312) and the bottom section (316) are integrally formed together to provide the cavity (11) for the stand-alone magnet (8) to be positioned therewithin. Alternatively, the cover (40) could be attached to the inner surface of the top section (312) by adhesive or molded with the top section (312), for example, during the injection molding process.

Figure 26:
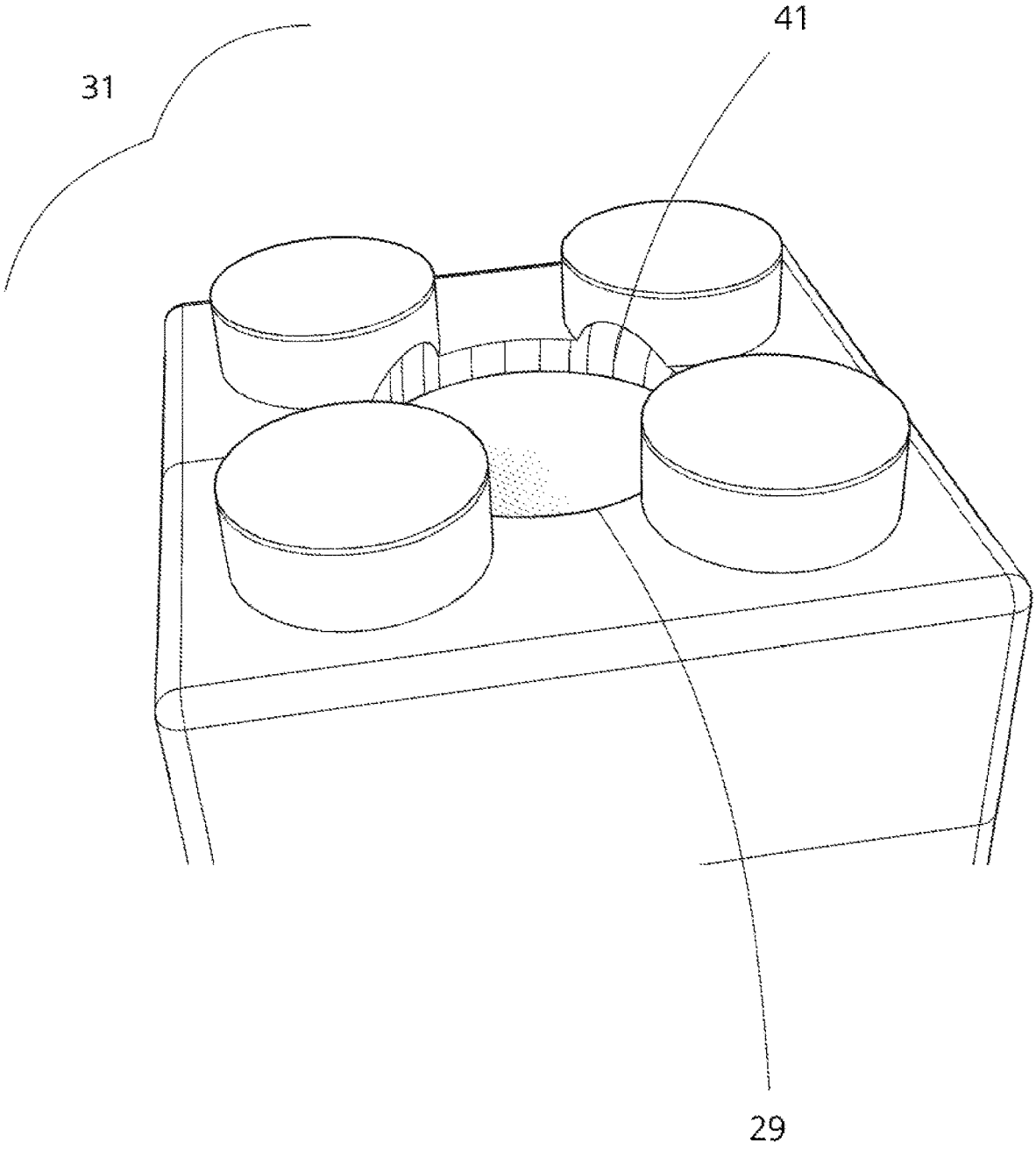
FIG. 26 shows a side perspective view of an embodiment of the disclosed block of the present invention with a magnet protrusion hole, the perimeter of which extends into the studs comprising male snapfit connection element.

In another embodiment, FIG. 26 shows the disclosed block (31) with an expanded magnet protrusion hole (29). The hole (29) is expanded such that portions of the male snapfit connection element have been cut away (41). Such a hole expansion (and snapfit element cut away) may be necessary to ensure that the disclosed block's (31) internal stand-alone magnet (8) may protrude far enough out of the magnet protrusion hole (29) (either with or without magnet protrusion hole cover (40)) to provide the magnetic pull force desired. The hole (29) should not be expanded to the point that the stand-alone magnet (8) can fully exit the block (31). Likewise, the "cut away" from the male snapfit element should not be so substantial as to negatively impact the element's primary function of connecting to other blocks.

Figure 8:
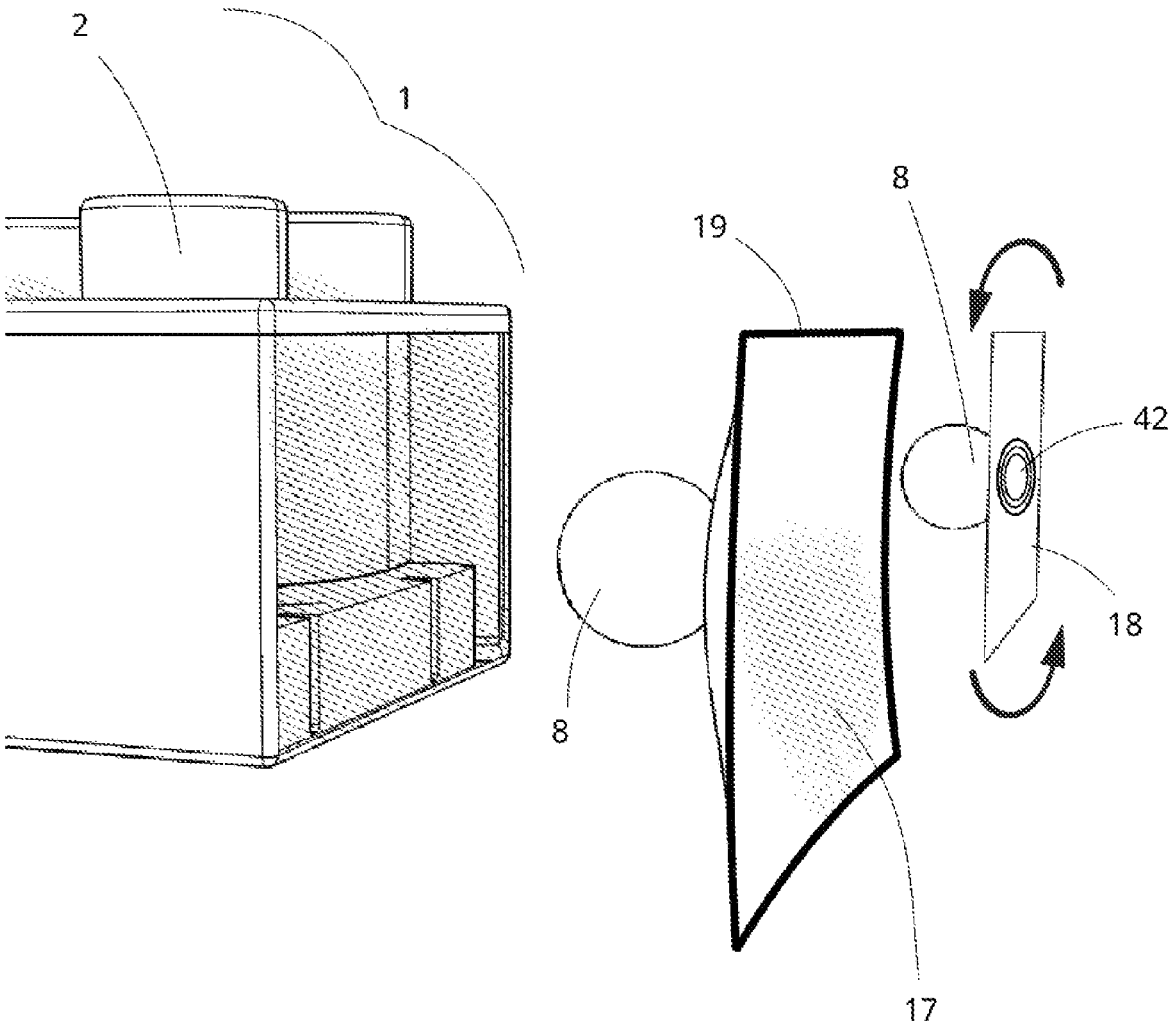
FIG. 8 shows a perspective view of a block of the present invention with one of its side faces removed as well as an alternative design for illustration purposes.

In some embodiments, as shown in FIG. 8, the disclosed block (1) may feature sides whose centers bow inwards (i.e., towards the center of the block), ensuring that the points of contact between the block's sides (17) and a magnetically attractable surface (14) exist on or near the sides' perimeters (19). Conversely, on a block with flat or planar sides (18), as shown in FIG. 8, the point(s) of contact with a magnetically attractable surface may become overly concentrated near a side's center (42). This arises from the fact that the internal stand-alone magnet (8) is designed to position itself near the side's center and subsequently, exert its pull-force through that region. A concentrated or singular point (42) of contact between the disclosed block and a magnetically attractable surface (14) can prove problematic, as the block (1) and any attached structure may be prone to unwanted rotational slipping on a magnetically attractable surface (14) about that singular point (42). Block sides that bow inward (17), however, ensure multiple, spread out points of frictional contact (19) between the block (1) and the surface (14), decreasing the likelihood of unwanted slippage and rotational movement.

Figure 10:
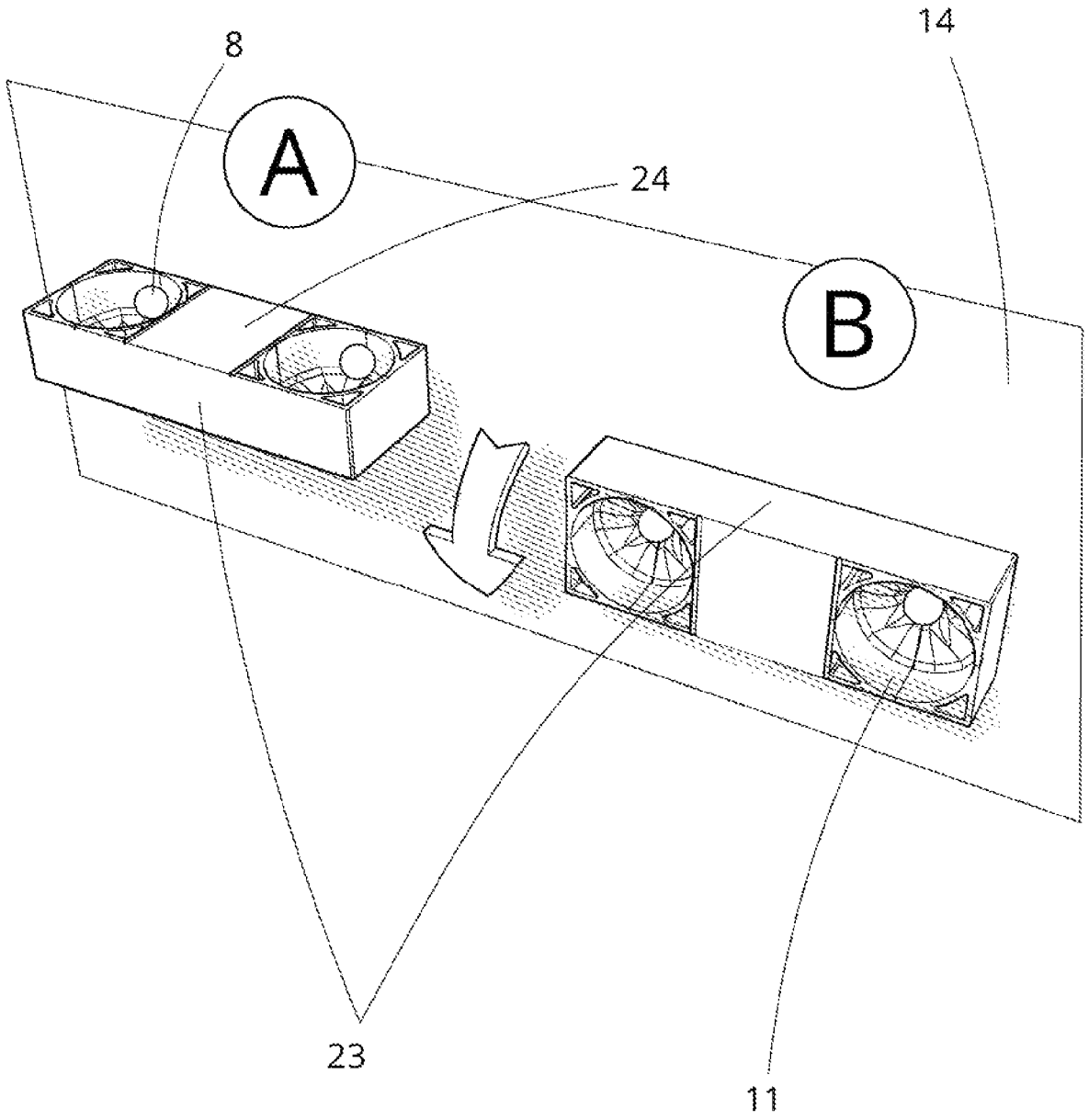
FIG. 10 shows perspective view of an alternative embodiment of a block of the present invention adhered to a surface by way of two magnets in two cavities. The top sides have been removed for illustration purposes.

In an alternative embodiment, as shown in FIG. 10, the disclosed block (23) contains two stand-alone magnets (8) in two cavities (11) for engagement with a surface in multiple orientations, including the two orientations (A), (B) shown. In some instances, a block (23) with two contained stand-alone magnets (8) may be preferable, i.e., when a larger block or stronger "pinning" force is needed. A gap (24) exists between the two cavities (11). The gap (24) is large enough such that the two stand-alone magnets (8) do not exert a meaningful pull-force on each other, leaving both free to exert a pull force on an external magnetically attractable surface (14). In orientation A, the stand-alone magnets (8) pin the disclosed block (23) via one of its sides to the magnetically attractable surface (14). In orientation B, the disclosed block (23) is rotated 90 degrees downwards. Upon rotating, the block's internal stand-alone magnets (8) reorient themselves proximate the block face now sharing planar contact with the magnetically attractable surface (14), thereby pinning the block (23) in its new orientation.

Figure 14:
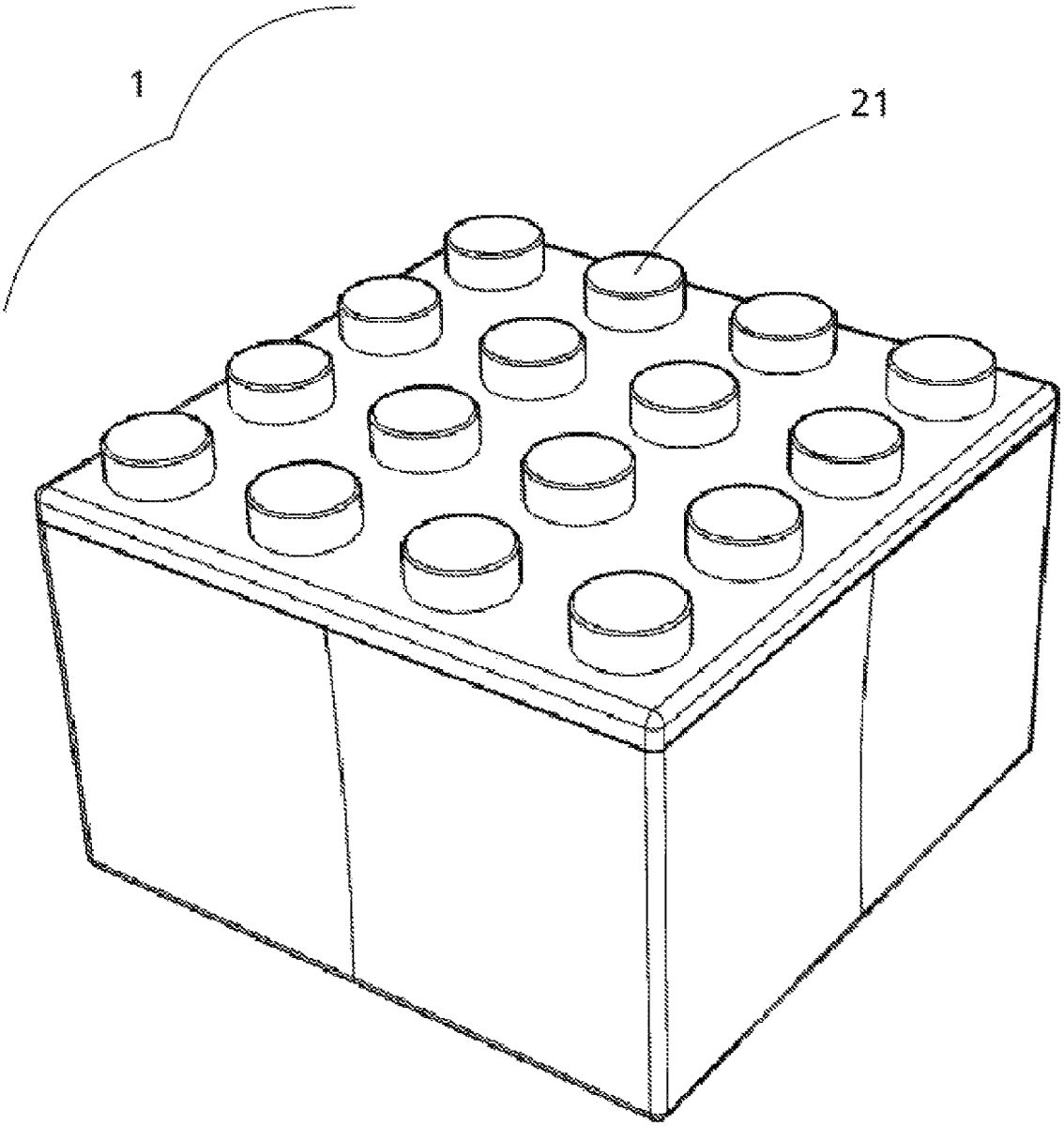
FIG. 14 shows a perspective view of an alternative embodiment of the disclosed block of the present invention featuring a male snapfit connection element containing a 4×4 pattern of "small-style" Lego® studs.
Figure 15:
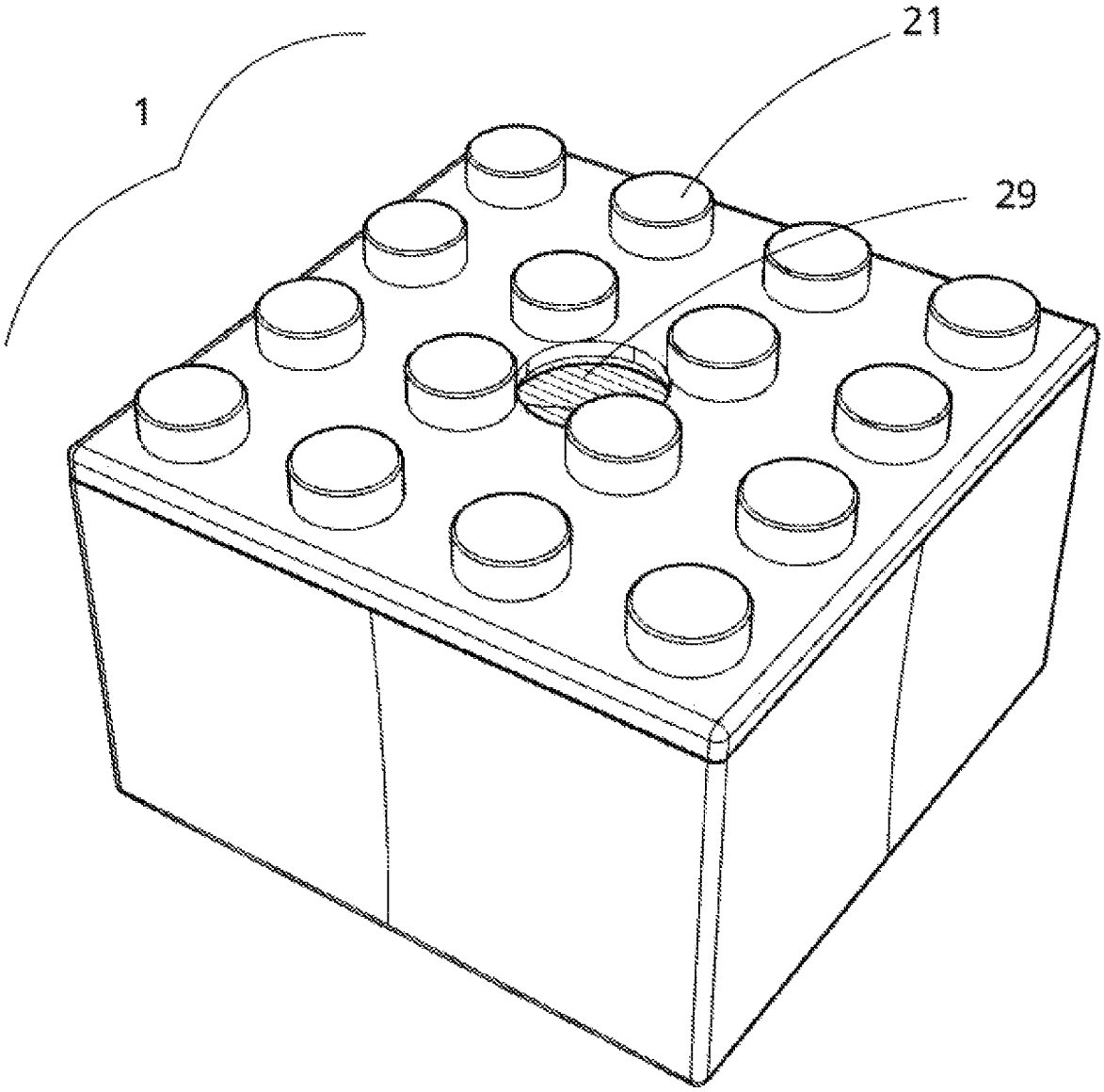
FIG. 15 shows a perspective view of the alternative embodiment of the disclosed block of the present invention with a magnet protrusion hole in the middle of the male snapfit connection element.
Figure 16:
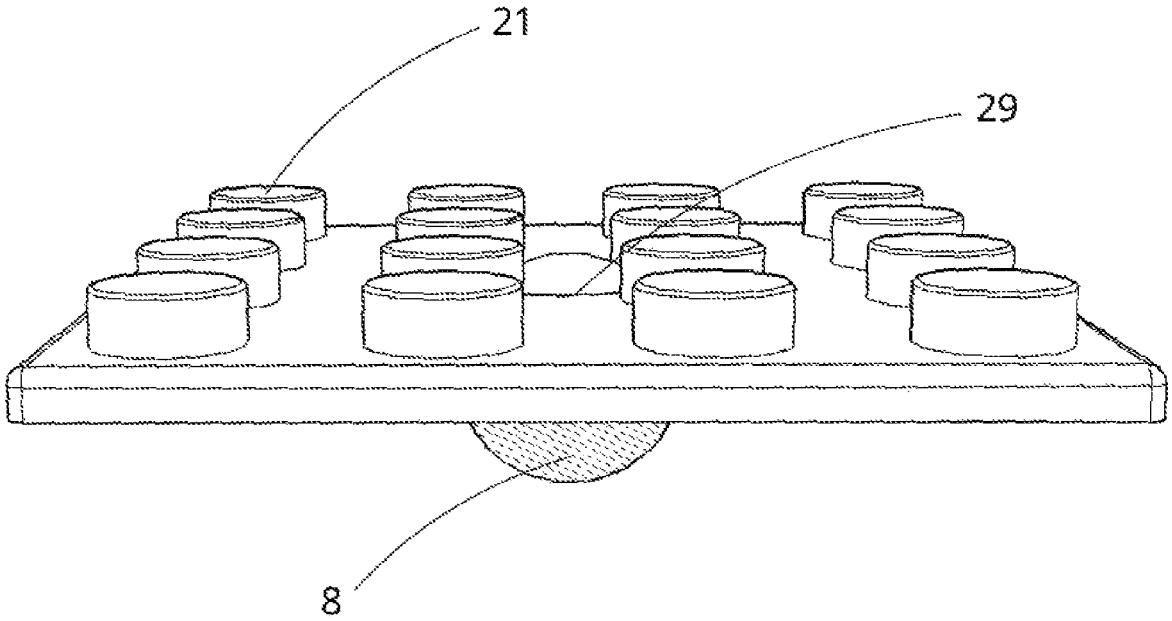
FIG. 16 shows a side perspective view of a top face of the disclosed block of FIG. 15.
Figure 17:
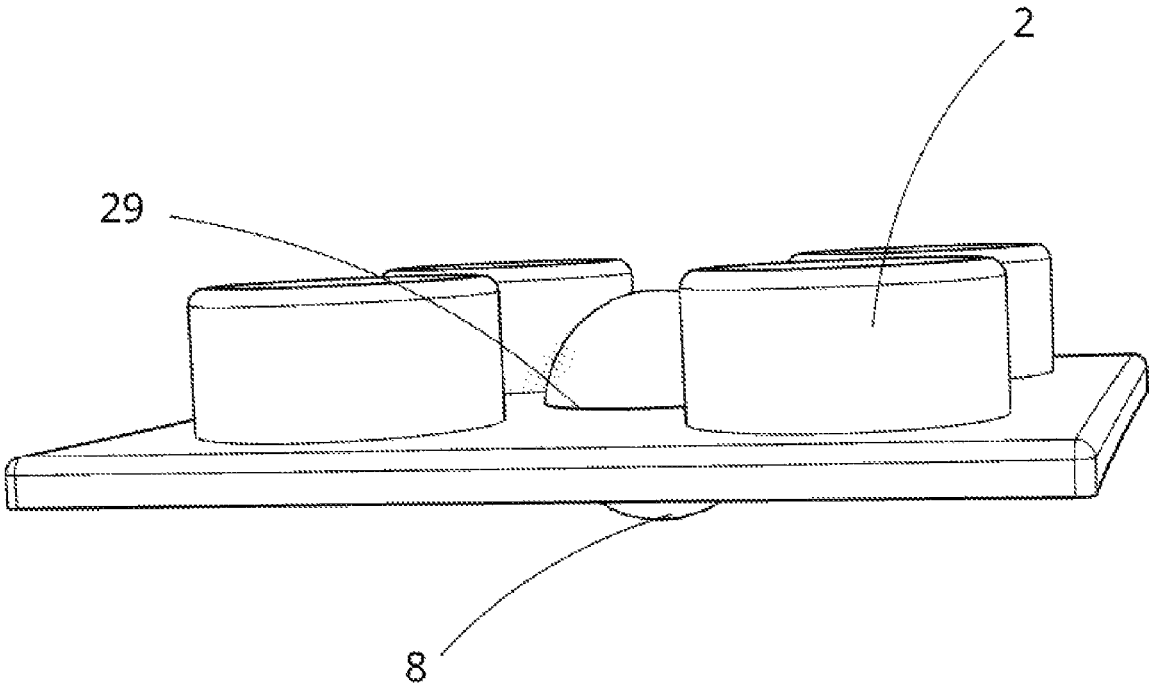
FIG. 17 shows a side perspective view of a top face of an embodiment of the disclosed block of the present invention containing "large-style" (e.g. Duplo®) "male" connection element and a cavity opening.

Other alternative embodiments are shown in FIGS. 14-17. In FIG. 14, the disclosed block (1) comprises a male snapfit connection element containing small-style male studs (21) in a 4 by 4 pattern. Such an embodiment allows the block to maintain the approximate size of a large-style 2×2 stud snapfit block, with the large-style 2×2 stud formation simply replaced by a small-style 4×4 formation. As shown in FIG. 15 the disclosed block (1) could include a magnet protrusion hole (29) in the center of the small-style, male snapfit element. As seen for example in FIG. 5C, the magnet protrusion hole (29) allows a portion of the block's internal stand-alone magnet (8) to protrude through the hole (29). As the stand-alone magnet (8) protrudes through the hole (29), the distance between itself and a magnetically attractable surface (14) positioned proximate the side of the hole (29) is decreased, increasing the effect of the magnetic pull force through that side. The result of adding a magnet protrusion hole (29) is that the disclosed block (1) can adhere to magnetically attractable surfaces (14) even through a side containing a male snapfit element. This configuration could be included in small-style male snapfit connection sides, as shown in FIG. 16, as well as large-style male snapfit sides, as shown in FIG. 17. As shown in the figures, the diameter of the hole (29) is smaller than the diameter of the stand-alone magnet (8) to ensure that a majority of the stand-alone magnet (8) remains within the interior of the block (1).

Figure 18:
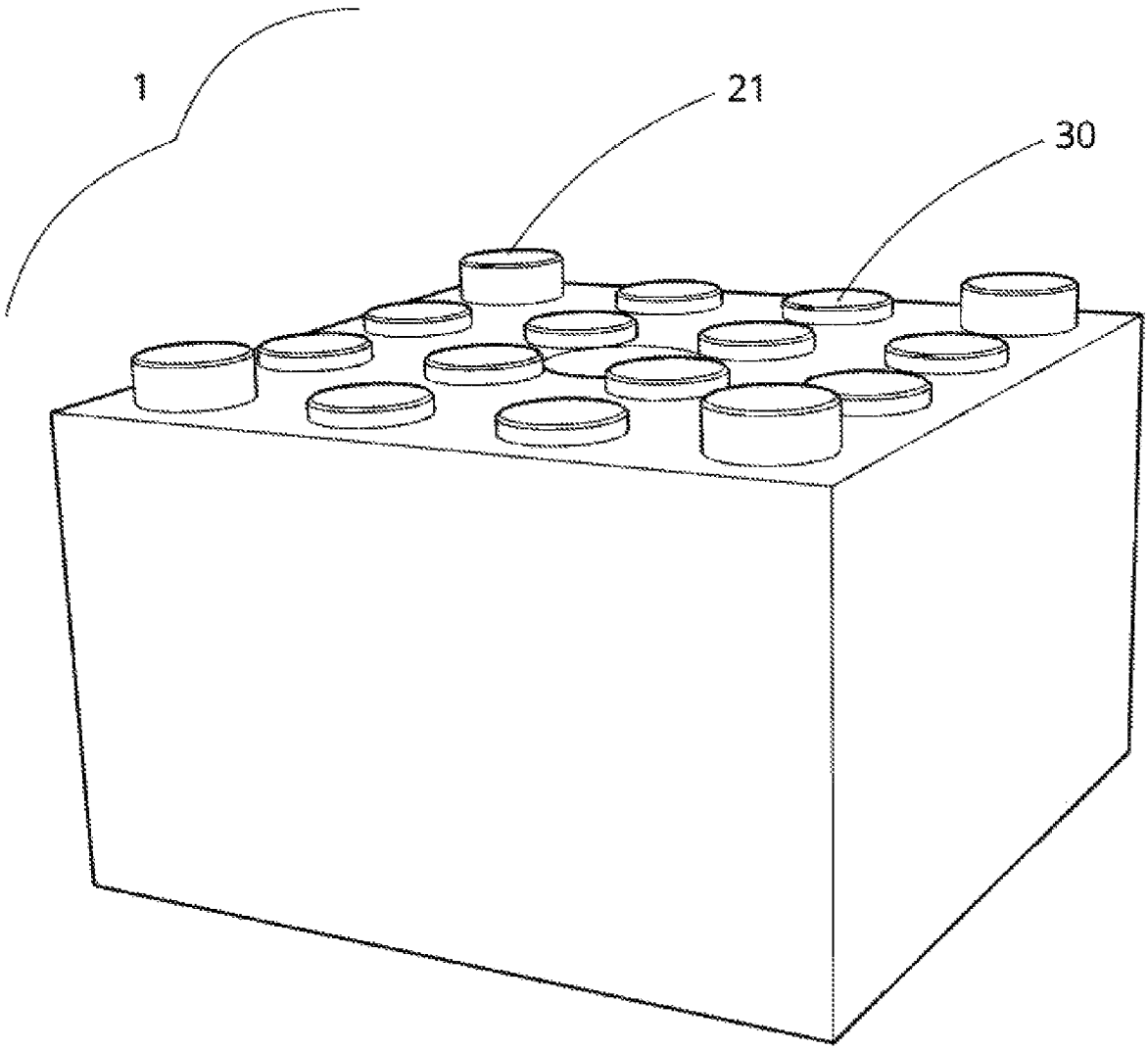
FIG. 18 shows a perspective view of another embodiment of the disclosed block of the present invention, wherein the studs comprising the "male" connection element are not all of uniform height.
Figure 19:
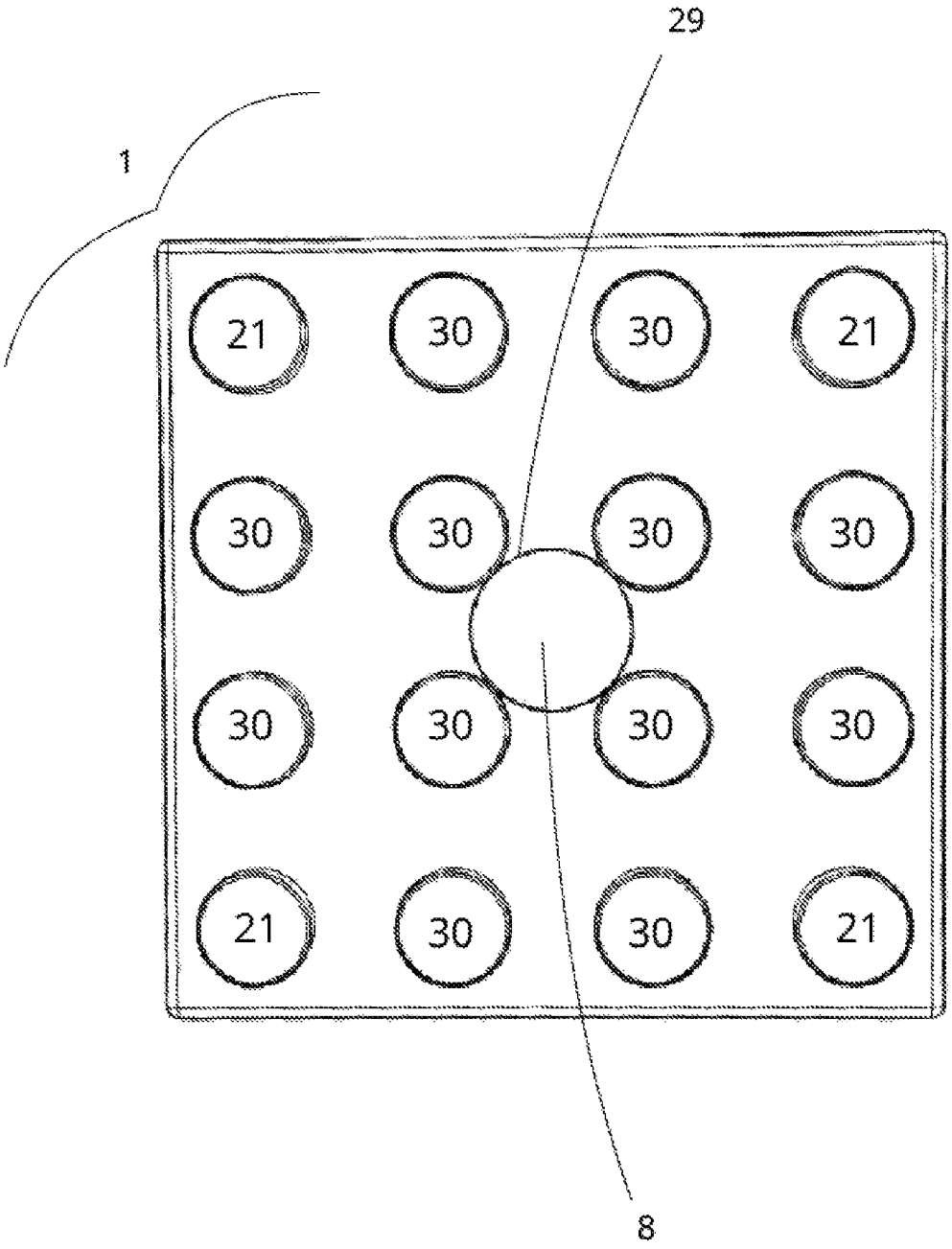
FIG. 19 shows a top plan view of the block shown in FIG. 18.

In other embodiments, as shown in FIGS. 18 and 19, the studs (21), (30) comprising the male snapfit element are of different heights. As shown, there are two stud heights: taller (21) and shorter (30). Having some studs that are taller than other studs ensures that, depending on their location, only the taller studs (21) can make contact with a magnetically attractable surface (14). Positioning the taller studs (21) on the outer corners of the side containing a male snapfit connection element ensures that the points of friction between that side and a magnetically attractable surface (14) will be nearer the perimeters of that side. As shown in FIG. 8, positioning the points of friction between the disclosed block (1) and a magnetically attractable surface (14) near the perimeter of the block's sides (19) helps to limit the undesirable rotational movement that can otherwise occur if the only points of friction are near a side's center. Shorter studs (30) need only be slightly shorter than taller studs (21) for the aforementioned frictional benefit to be achieved. All studs (30) must remain tall enough to serve their primary function of successfully snap-fitting with the female snapfit connection element of another block. The taller studs (21) are positioned near the side's corners to optimize the location of the friction that occurs between the block (1) and a magnetically attractable surface (14).

Figure 20:
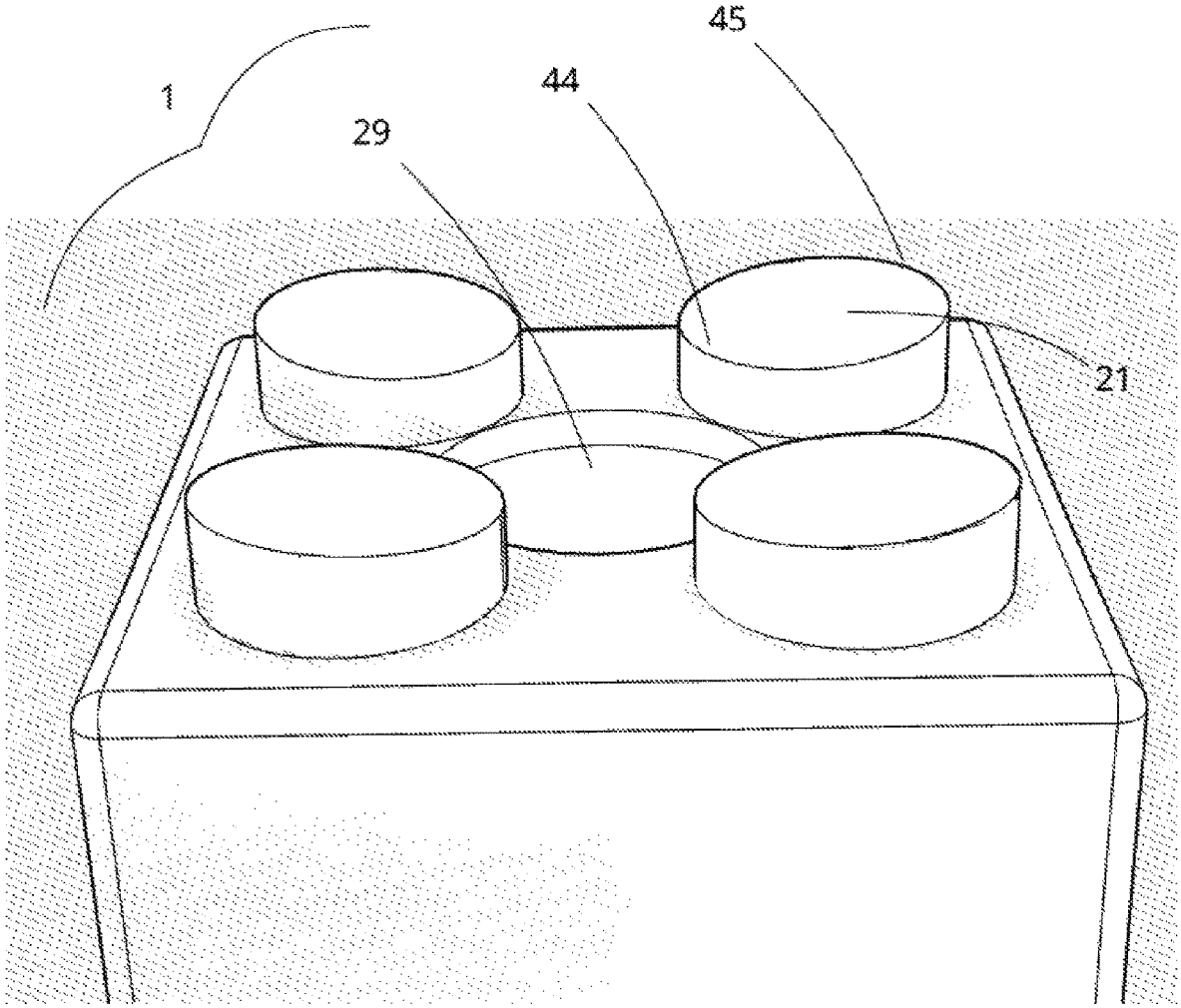
FIG. 20 shows a top side perspective view of another embodiment of the disclosed block of the present invention, wherein each stud comprising the male snapfit element is not of uniform height.

In some embodiments, as shown in FIG. 20, each stud (21) is not of uniform height. In particular, the portion (44) of each stud (21) located nearest the magnet protrusion hole (29) is the shortest portion of the stud (21); conversely, the tallest portion of each stud (45) occurs furthest from the magnet protrusion hole (29). As with the previous embodiment of FIGS. 18 and 19, the stud height differential serves to move the points of frictional contact made with a magnetically attractable surface (14) closer to that side's perimeter. Having the points of frictional contact spread to the perimeter of the male snapfit element—rather than near its center—helps to prevent the block (1) from rotating on a magnetically attractable surface (14) undesirably.

Figure 23:
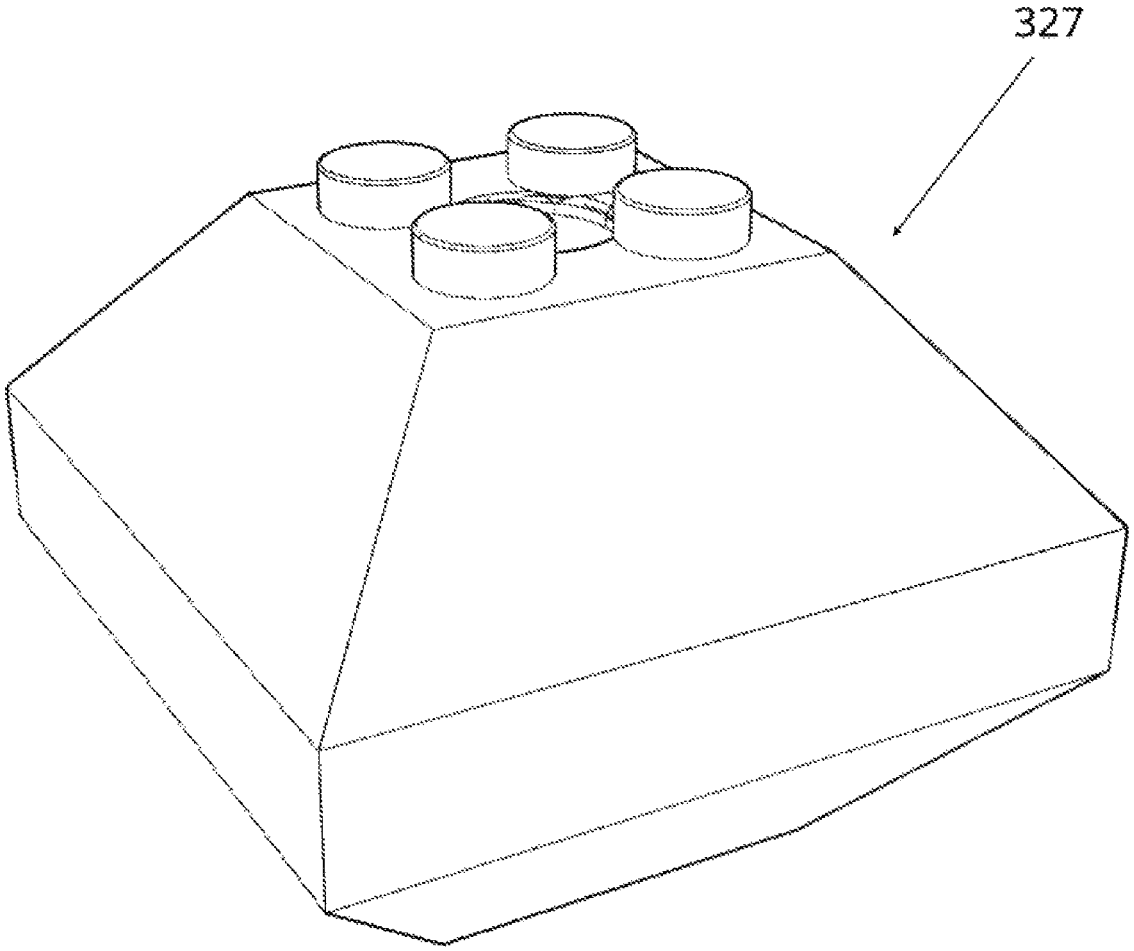
FIG. 23 is an alternative embodiment of the disclosed block wherein the block has more than six exterior faces.

In another embodiment shown in FIG. 23, the disclosed block 327 is shown to have more than six outward facing sides. Such an embodiment facilitates construction at oblique angles from the magnetically receptive surface.

The present invention overcomes the limitations of the prior art with a block that contains a freely movable stand-alone magnet(s) that is capable of providing a foundation for non-magnetic block structures. Structures built with the disclosed block are less limited in orientation than traditional snapfit block structures, as they can be rotated 360 degrees on the same plane as, and/or 360 degrees out from, a magnetically attractable surface. Furthermore, they do not require a substantially horizontal underlying surface; rather, they may instead be positioned anywhere on a magnetically attractable surface (which, itself, may be at any angle or even vertical). Additionally, structures built using the disclosed block in conjunction with non-magnetic snapfit blocks can be significantly cheaper than structures built entirely with magnetic blocks.

The present invention may be embodied in other specific forms without departing from its spirit or essential characteristics. The described embodiments are to be considered in all respects only as illustrative and not restrictive. The scope of the invention will be, therefore, indicated by the claims rather than by the foregoing description. All changes which come within the meaning and range of equivalency of the claims are to be embraced within their scope.

The invention claimed is:

1. A construction block comprising:

a plurality of sides integrally formed together to form a substantial enclosure, each side having an inner surface and an outer surface;

a stand-alone magnetic member located within the enclosure, the magnetic member being freely movable within the enclosure;

a first aperture extending from the enclosure through a first side of the plurality of sides;

a flexible cover positioned proximate the first aperture on an inner surface of the first side; and an intermediate member, the intermediate member having a top section and a side section;

wherein the top section is positioned adjacent the cover opposite the first side such that the cover is secured therebetween;

wherein the side section forms a side of the enclosure; and wherein the magnetic member is capable of partially extending through the first aperture.

2. The construction block of claim 1, wherein the magnetic member has a first diameter and the first aperture has a second diameter, the first diameter being greater than the second diameter.

3. The construction block of claim 1, wherein the inner surface of the first side includes an indent, the cover being fixed within the indent.

4. The construction block of claim 1, wherein the stand-alone magnetic member is free to travel within the enclosure such that its magnetic force can be effectuated through more than one side of the enclosure, one side at a time.

5. The construction block of claim 4, further comprising an inner cavity formed within the enclosure, the stand-alone magnetic member located within the inner cavity, the inner cavity comprising a second aperture proximate a second side of the plurality of sides, the second side being fully enclosed.

6. The construction block of claim 5, wherein an inner surface of the inner cavity proximate the second aperture comprises an indent.

7. The construction block of claim 1, wherein the magnetic member is freely movable unimpeded within the enclosure.

8. A construction block comprising:

a plurality of sides integrally formed together to form a substantial enclosure, each side having an inner surface and an outer surface;

an inner cavity formed within the enclosure, the inner cavity having a wall;

a stand-alone magnetic member located within the inner cavity, the magnetic member being freely movable within the inner cavity;

a first aperture extending through a first side of the plurality of sides of the enclosure; and a first engagement member extending outwardly from an outer surface of one of the plurality of sides and a second engagement member extending inwardly into an outer surface of another one of the plurality of sides, each of the first and second engagement members being engageable with outer construction blocks;

wherein the magnetic member is capable of partially extending through the first aperture.

9. The construction block of claim 8, wherein the inner surface of one of the plurality of sides comprises an indent.

10. The construction block of claim 8, further comprising a plurality of the first engagement members, wherein at least two of the first engagement members have different heights relative to the outer surface of the one of the plurality of sides.

11. The construction block of claim 8, wherein the stand-alone magnetic member is free to travel unimpeded within the inner cavity such that its magnetic force can be effectuated through more than one side of the enclosure, one side at a time.

12. The construction block of claim 11, wherein the inner cavity comprises a second aperture proximate a second side of the plurality of sides, the second side being fully enclosed.

13. The construction block of claim 12, wherein an inner surface of the inner cavity proximate the second aperture comprises an indent.

* * * * *